US011756350B2

(12) United States Patent
Griffin et al.

(10) Patent No.: US 11,756,350 B2
(45) Date of Patent: Sep. 12, 2023

(54) MODEL DEVELOPMENT USING PARALLEL DRIVING DATA COLLECTED FROM MULTIPLE COMPUTING SYSTEMS

(71) Applicant: Rivian IP Holdings, LLC, Plymouth, MI (US)

(72) Inventors: Joseph Frank Griffin, Bonita, CA (US); Timothy Haugaard, Honolulu, HI (US); Thomas Rideout, Snohomish, WA (US); Michael P. Slattery, Irvine, CA (US)

(73) Assignee: Rivian IP Holdings, LLC, Plymouth, MI (US)

( * ) Notice: Subject to any disclaimer, the term of this patent is extended or adjusted under 35 U.S.C. 154(b) by 275 days.

(21) Appl. No.: 17/038,215

(22) Filed: Sep. 30, 2020

(65) Prior Publication Data

US 2022/0101662 A1 Mar. 31, 2022

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 5/085* (2013.01)

(58) Field of Classification Search
CPC ..... G07C 5/0808; G07C 5/008; G07C 5/085
USPC ..... 701/33.4
See application file for complete search history.

(56) References Cited

U.S. PATENT DOCUMENTS

| | | | | |
|---|---|---|---|---|
| 9,147,353 | B1 * | 9/2015 | Slusar | G06Q 40/08 |
| 9,535,878 | B1 * | 1/2017 | Brinkmann | G08G 1/0112 |
| 10,825,269 | B1 * | 11/2020 | Brinkmann | G07C 5/0841 |
| 10,899,358 | B2 * | 1/2021 | Persia | B60W 40/09 |
| 11,260,873 | B1 * | 3/2022 | Ferguson | B60W 40/09 |
| 11,479,258 | B1 * | 10/2022 | Sanchez | B60W 50/14 |
| 2019/0367039 | A1 * | 12/2019 | Persia | G06V 20/597 |

* cited by examiner

*Primary Examiner* — Mahmoud Gimie
(74) *Attorney, Agent, or Firm* — Clements Bernard Walker; Christopher L. Bernard

(57) ABSTRACT

Disclosed embodiments include systems, vehicles, and computer-implemented methods for developing a model from parallel sets of driving data to identify the risk level of an event in one of the sets of driving data. In an illustrative embodiment, a system includes a vehicle data system operably coupled with at least one sensor aboard a vehicle to collect vehicle driving data representing driving conduct. A portable data collection module is configured to cause a portable computing system transportable aboard a vehicle to collect portable driving data representing the driving conduct. An evaluation system is configured to receive the portable driving data and the vehicle driving data, assign a risk level to at least one event included in the vehicle driving data, and correlate the vehicle driving data with the portable driving data to identify a pattern in the portable driving data that is associable with the risk level.

18 Claims, 14 Drawing Sheets

MODEL DEVELOPMENT USING PARALLEL DRIVING DATA COLLECTED FROM MULTIPLE COMPUTING SYSTEMS

INTRODUCTION

The present disclosure relates to developing a model from parallel sets of data regarding a vehicle-related incident to prospectively evaluate subsequent vehicle-related incidents.

The statements in this section merely provide background information related to the present disclosure and may not constitute prior art.

Modern vehicles may include operator warning systems to help encourage drivers to drive more safely by, for example, warning the driver when the vehicle departs from its lane or is in proximity to another object. Some vehicles also may include operator assistance features that, by corresponding example, help guide the vehicle to avoid lane departures and automatically engage the steering mechanism or brakes to attempt to avoid colliding with other objects. These systems may use data from a number of sensors that monitor operation of the driver and the vehicle and/or control the vehicle. The data from these sensors also may prove useful in monitoring conduct of a driver so that, when a loss-related incident occurs, it may be determined whether the driver may or may not have been at fault.

Currently, insurance providers provide smartphone applications that may be used to monitor some driving behavior of drivers. For example, these applications may use global positioning system (GPS) devices and accelerometers incorporated in smartphones to monitor when a vehicle travels at excessive speed, brakes abruptly, or whether the driver uses his or her phone while driving. The insurance providers may offer a discount to the driver when the driver does not speed, avoids hard braking, and drives without handling his or her smartphone.

However, avoiding actions such as hard braking may not indicate whether a driver is a careful driver. For example, a driver may be very attentive and hard braking may be the only thing that prevented a collision when a car abruptly and inappropriately moved into the driver's path. Thus, in this example, relying on hard braking data alone may not be a reliable indicator of what happened in a particular event or the level of care employed by the driver.

SUMMARY

Disclosed embodiments include systems, vehicles, and methods for developing a model from parallel sets of driving data to identify the risk level of an event in one of the sets of driving data.

In an illustrative embodiment, a system includes a vehicle data system operably coupled with at least one sensor aboard a vehicle and configured to collect vehicle driving data representing driving conduct of an operator during at least one trip. A portable data collection module is configured to cause a portable computing system transportable aboard a vehicle to collect portable driving data representing the driving conduct of the operator in operating the vehicle during the at least one trip. An evaluation system is configured to receive the portable driving data and the vehicle driving data, assign a risk level to at least one event included in the vehicle driving data and correlate the vehicle driving data with the portable driving data to identify a pattern in the portable driving data that is associable with the risk level.

In another illustrative embodiment, a vehicle includes a cabin configured to receive an operator, a passenger, and/or cargo. A drive system is configured to motivate, accelerate, decelerate, stop, and steer the vehicle. An operator control system is configured to allow the operator to direct operations of the vehicle. An operator assist system is configured autonomously control the vehicle without assistance of the operator and/or assist the operator in controlling the vehicle. A vehicle data system is operably coupled with at least one sensor aboard a vehicle and configured to collect vehicle driving data representing driving conduct of the operator in operating the vehicle during at least one trip. A portable data collection module is configured to cause a portable computing system transportable aboard a vehicle to collect portable driving data representing the driving conduct of the operator in operating the vehicle during the at least one trip. An evaluation system is configured to receive the portable driving data and the vehicle driving data, assign a risk level to at least one event included in the vehicle driving data and correlate the vehicle driving data with the portable driving data to identify a pattern in the portable driving data that is associable with the risk level.

In another illustrative embodiment, a computer-implemented method includes receiving vehicle driving data collected by a vehicle data system operably coupled with at least one sensor aboard a vehicle and configured to collect data representing driving conduct of the operator in operating the vehicle during at least one trip. Portable driving data is received from a portable data system transportable aboard the vehicle to collect data representing the driving conduct of the operator in operating the vehicle during the at least one trip. The vehicle driving data and the portable driving data are evaluated. The evaluation includes assigning a risk level to at least one event included in the vehicle driving data. The evaluation also includes correlating the vehicle driving data with the portable driving data to identify a pattern in the portable driving data that is associable with the risk level.

Further features, advantages, and areas of applicability will become apparent from the description provided herein. It will be appreciated that the description and specific examples are intended for purposes of illustration only and are not intended to limit the scope of the present disclosure.

DRAWINGS

The drawings described herein are for illustration purposes only and are not intended to limit the scope of the present disclosure in any way. The components in the figures are not necessarily to scale, with emphasis instead being placed upon illustrating the principles of the disclosed embodiments. In the drawings.

Figures 12A, 12B, 12C:
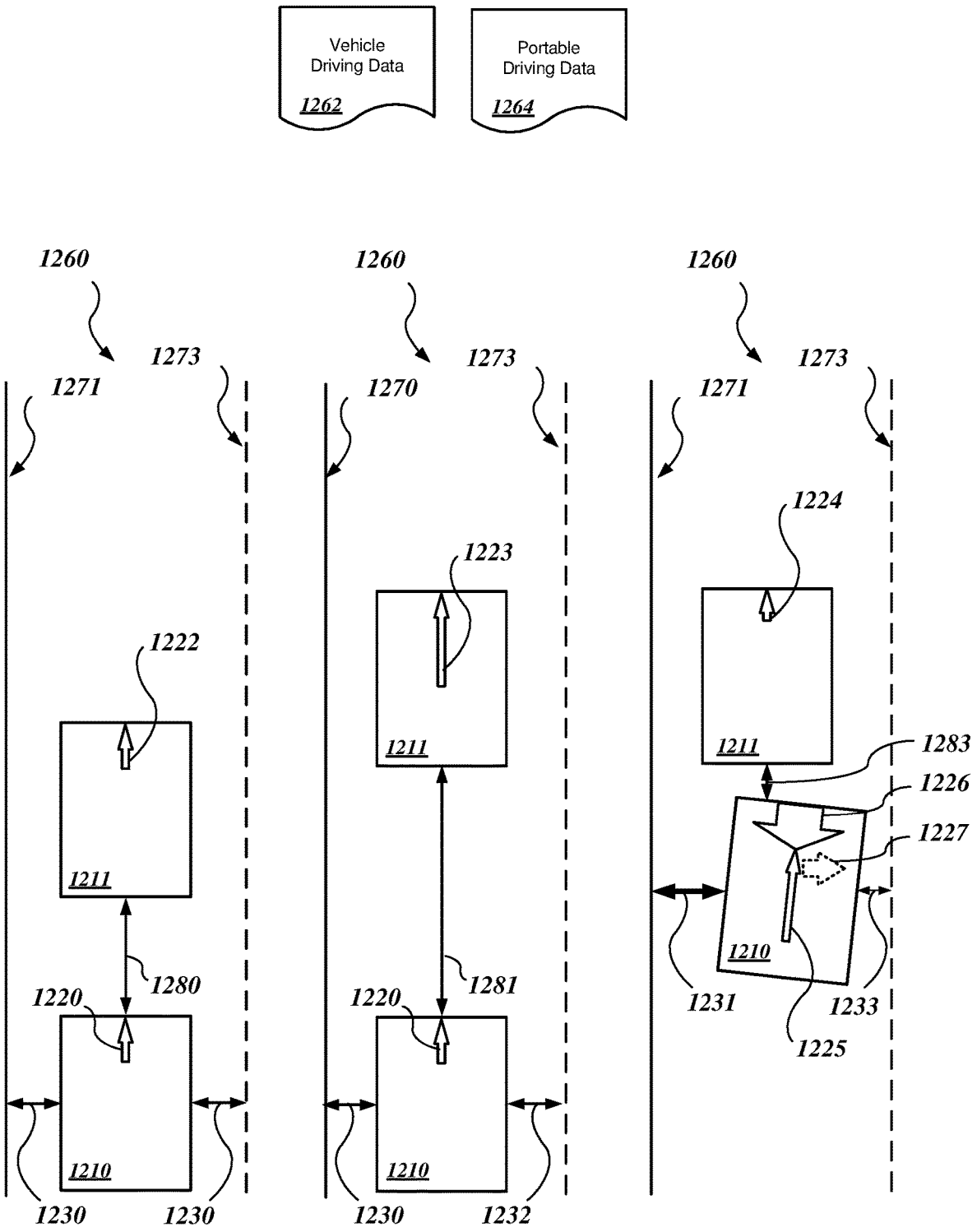
Figure 13A:
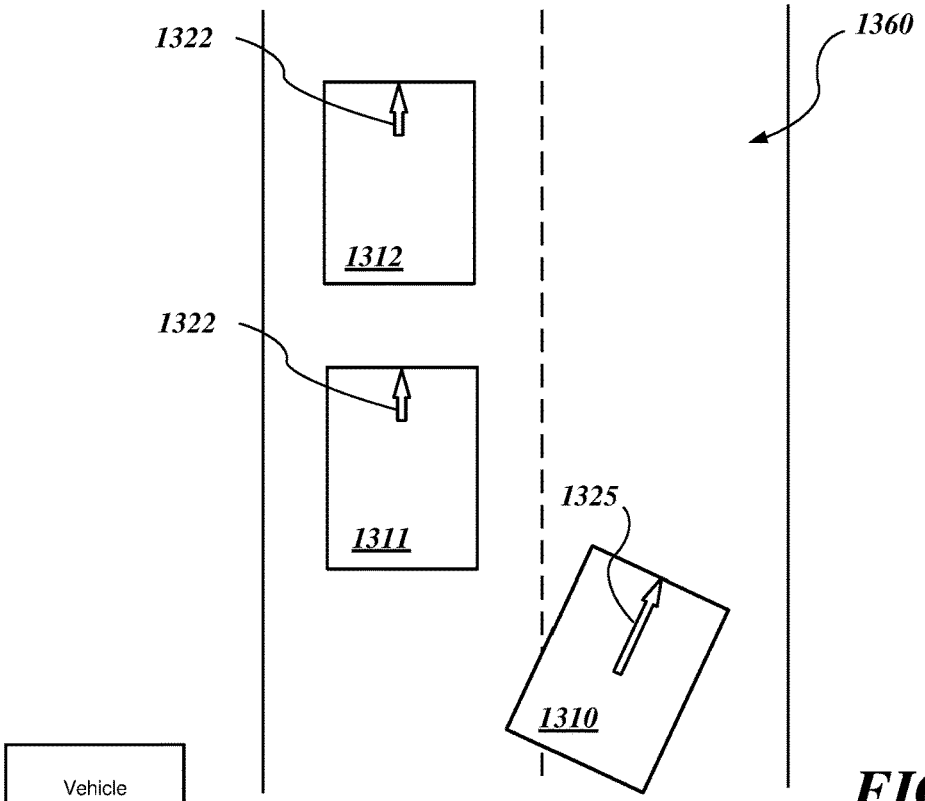
Figure 13B:
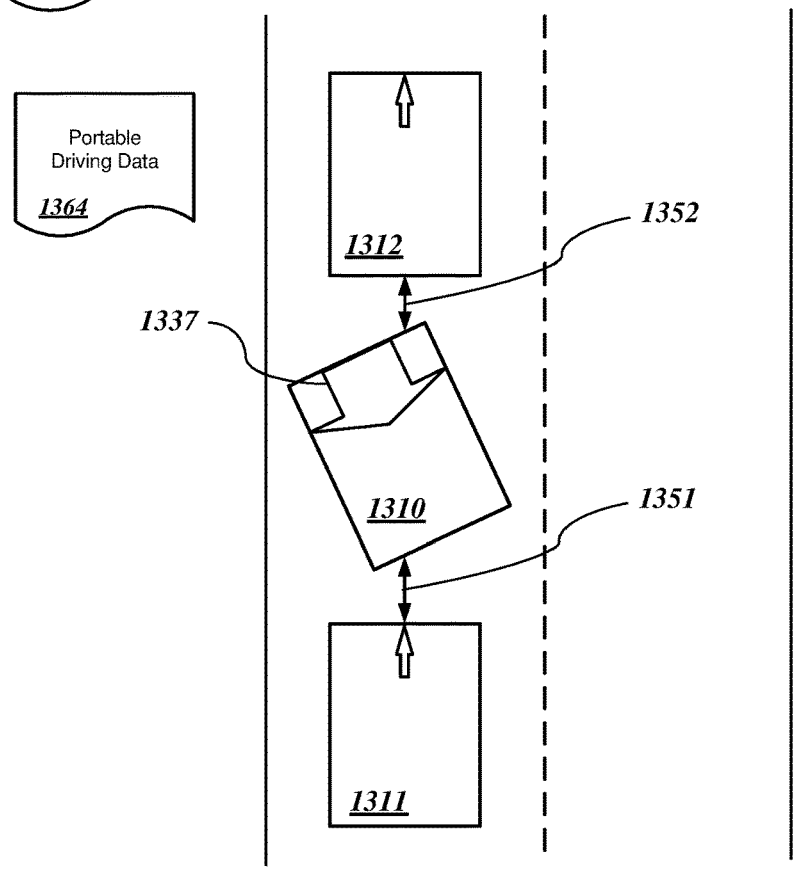
Figure 14:
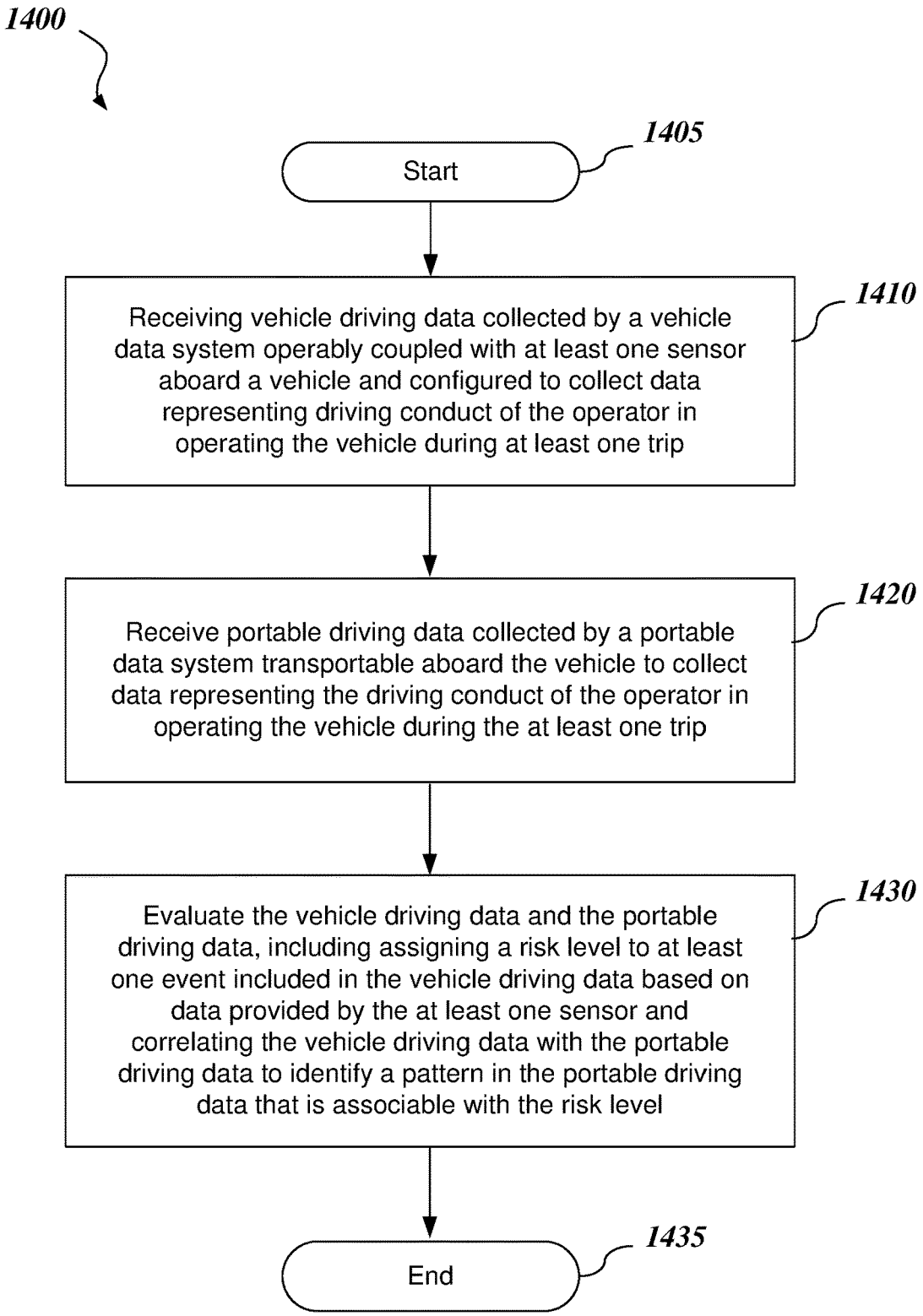

FIGS. 9A, 9B, 10, 11A, 11B, 12A, 12B, 12C, 13A, and 13B are schematic diagrams of driving events representable in sets of driving data; and FIG. 14 is a flow chart of an illustrative method of developing a model from parallel sets of driving data.

DETAILED DESCRIPTION

The following description is merely illustrative in nature and is not intended to limit the present disclosure, application, or uses. It will be noted that the first digit of three-digit reference numbers and the first two digits of four-digit reference numbers correspond to the first digit or digits of the figure numbers, respectively, in which the referenced element first appears.

The following description explains, by way of illustration only and not of limitation, various embodiments of systems, vehicles, and methods for developing a model from parallel sets of driving data to identify the risk level of an event in one of the sets of driving data.

Figure 1:
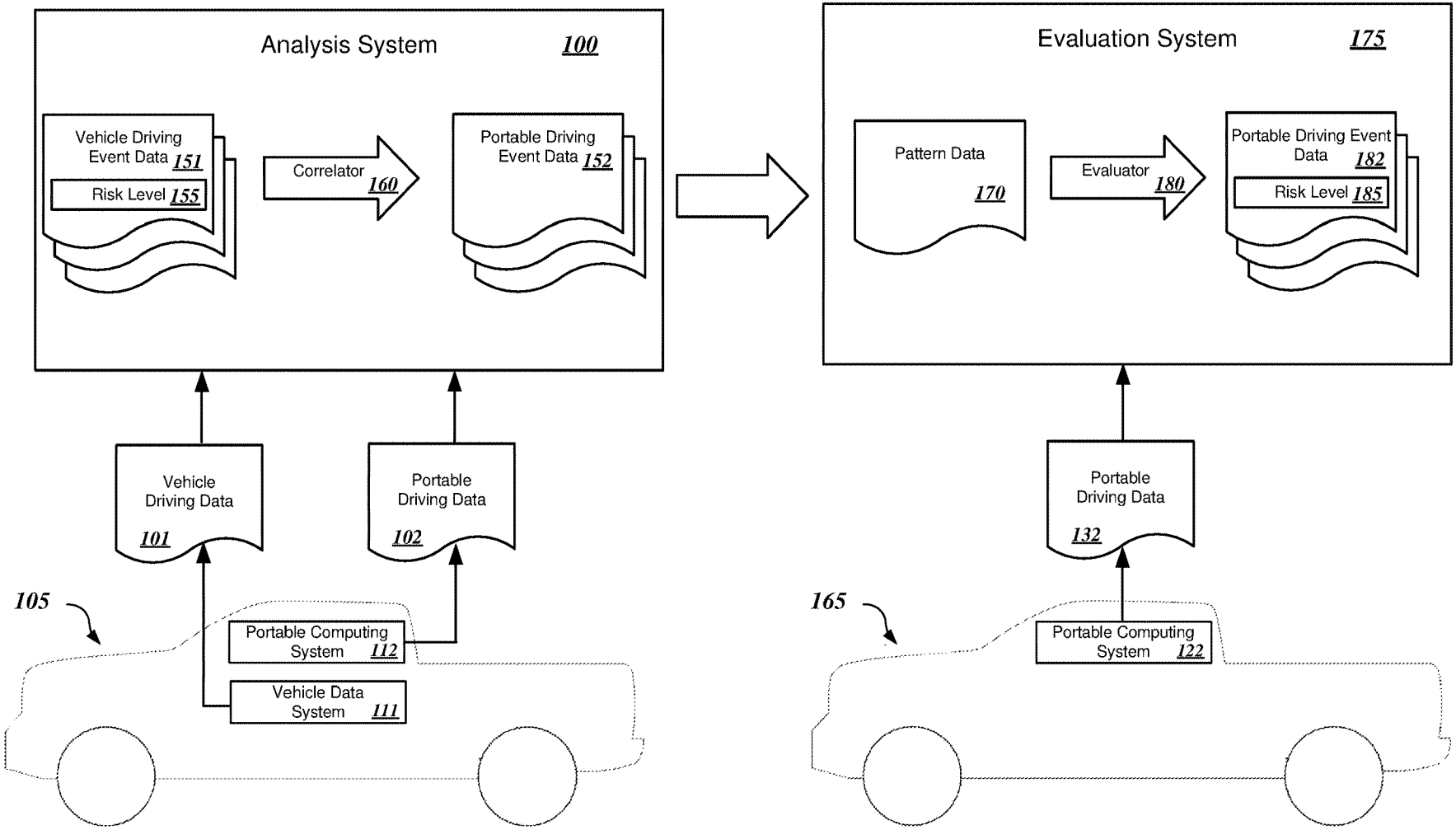
FIG. 1 is a block diagram in partial schematic form of an illustrative system for collecting and evaluating driving data from multiple computing systems.

Referring to FIG. 1, various embodiments of the present disclosure include an analysis system 100 that processes vehicle driving data 101 received from a vehicle data system 111 that is incorporated within a vehicle 105 and portable driving data 102 received from a portable computing system 112, such as a smartphone, that is transportable aboard the vehicle 105. As described further below, each of the vehicle driving data 101 and the portable driving data 102 may include data representative of events that take place during operation of the vehicle 105. The portable driving data 102, for example, may include many different types of information that is monitorable by the portable computing system 112, ranging from data receivable from a GPS device, a gyroscope, accelerometers, cameras, microphones, and data from any other types of sensor that may be incorporated in or in communication with the portable computing device 112 including, for example, sensors described below with reference to FIG. 8. Thus, the portable driving data may include data that reflects events related to vehicle operations, such as acceleration, speed, braking, abrupt turning, and other vehicle operations. The vehicle driving data 111 may include the same data as included in the portable driving data 112 but also may include many other types of data. In various embodiments, the vehicle driving data 111 may include camera data to show the scene presented to the operator, following distance data to show how closely the vehicle was following other vehicles, brake pedal data to indicate whether the operator had a foot on the brake to prepare to stop, and many other forms of data.

In various embodiments, the analysis system 100 is configured to extract one or more sets of vehicle driving event data 151 from the vehicle driving data 101 and to extract one or more sets of portable driving event data 152 from the portable driving data 102. The sets of vehicle driving event data 151 may be identified or selected based on data values that exceed various thresholds, such as instances of hard braking, excessive speeding, abrupt turning, issuance of lane departure or object proximity warnings, etc. Based on a severity of indicia associated with each of the sets of vehicle driving data 151, a risk level 155 may be assigned indicative of the risk presented by the event.

A correlator 160 is used to associate the sets of vehicle driving event data 151 with sets of portable driving event data 152. In various embodiments, the sets of portable driving event data 152 may be correlated with the sets of vehicle driving event data 151 by their respective time stamps. Smartphones and similar communication-enabled portable computing system used as a portable computing system 112 regularly synchronize their clocks with a centralized system which also could be used to synchronize the time of the vehicle data system 111. Thus, the sets of event data 151 and 152 may be readily matched according to times at which data associated related to the events were recorded. Under various circumstances, clocks may not be fully synchronized. In these situations, using other elements like speed, GPS, Bluetooth, proximity sensors, etc. may be used to match the sets of event data 151 and 152.

An output of the analysis system 100 is pattern data 170. The pattern data 170 may be used to evaluate portable driving event data 182 to evaluate the represented events from data collected from a vehicle 165 that does not include a vehicle data system like that of the vehicle 105. By comparing the portable driving event data 152 with the sets of vehicles driving event data 151 that may be assigned relatively high risk levels 155, it is possible to identify aspects of the portable driving data 152 that are indicative of the associated high-risk levels 155. Comparison of the vehicle driving event data 151 with the portable driving event data 182 allows for discernment of events representable in the portable driving event data 182 that otherwise may not be discernable or properly evaluated from the portable driving event data 182 alone. Specific types of data included in the vehicle driving event data 151 may allow for proper contextualization and understanding of the portable driving event data 182 that may not be understood even upon thorough evaluation of mass quantities of portable driving event data 182 alone. As a result, when an individual operates the vehicle 165, an evaluation system 175 using the pattern data 170 may be able to assign risk levels 185 to sets of portable driving event data 182 extracted from the portable driving data 132 generated by the portable computing system 122 alone.

Figure 2:
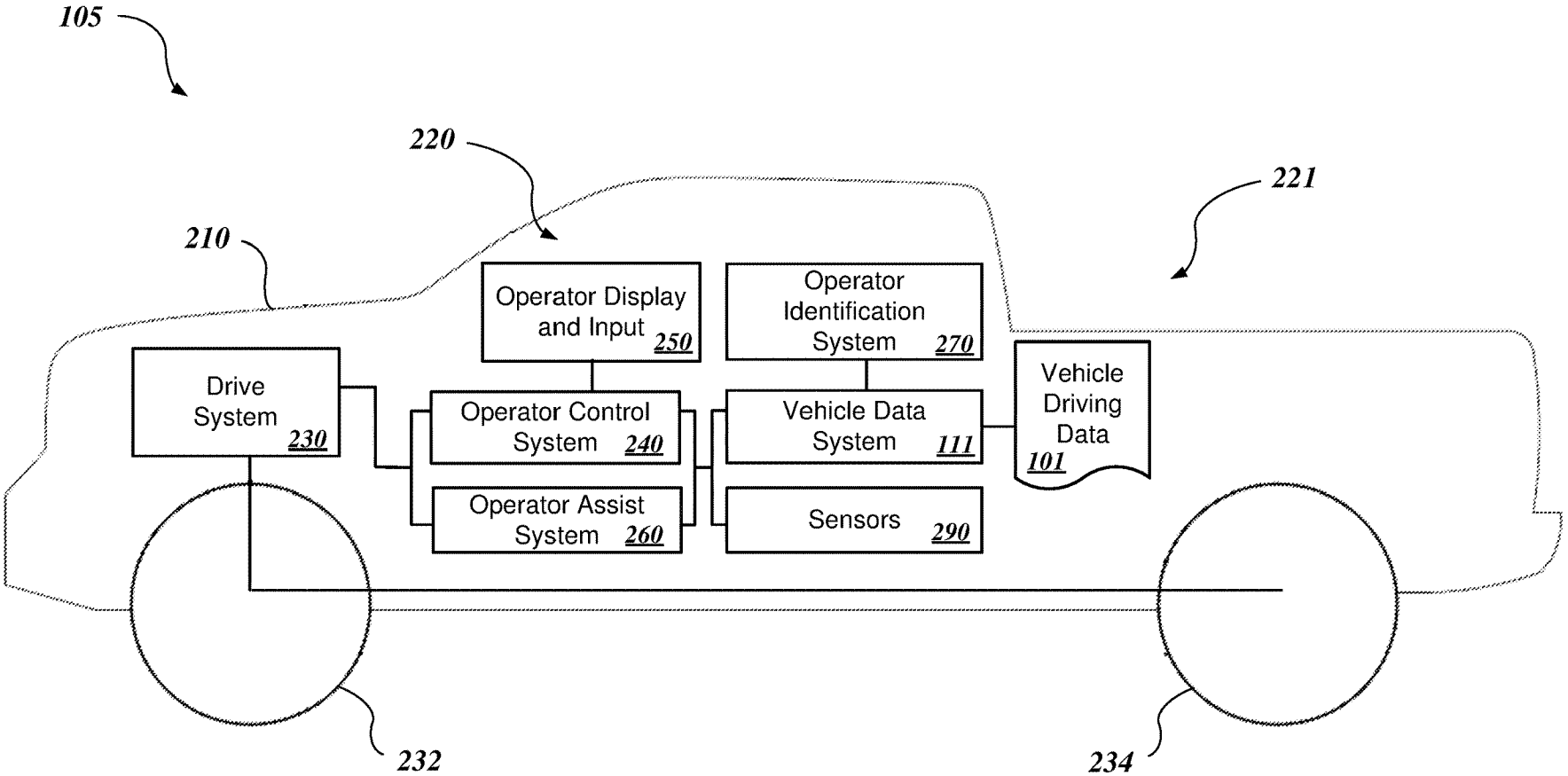
FIG. 2 is a block diagram of a vehicle including a vehicle data system and a portable computing system to collect driving data.

Referring to FIG. 2, the vehicle 105 that includes the vehicle data system 111 may include a car, truck, sport utility vehicle (SUV), or similar vehicle for on-road and/or off-road travel. The vehicle 105 includes a body 210 that supports a cabin 220 to accommodate an operator, one or more passengers, and/or cargo. The vehicle 105 may be a self-driving or autonomous vehicle that may operate without an operator or passengers aboard. The body 210 of the vehicle 105 also may include an additional cargo section 221, such as a trunk or a truckbed.

The vehicle 105 includes a drive system 230 that, in concert with front wheels 232 and/or rear wheels 234, motivates, accelerates, decelerates, stops, and steers the vehicle 105. In various embodiments, the drive system 230 is directed by an operator control system 240 and/or an operator assist system 260. The operator control system 240 works in concert with an operator display and input system 250 within the cabin 220. The operator display and input system 250 includes all the operator inputs, including the steering controls, the accelerator and brake controls, and all other operator input controls. The operator display and input system 250 also includes the data devices that provide information to the operator, including the speedometer, tachometer, fuel gauge, temperature gauge, and other output devices. When the vehicle 105 is equipped with the operator assist system 260, the operator display and input system 250 also allow the operator to control and interact with the operator assist system 260.

The operator assist system 260 includes available automated, self-driving capabilities or other features that assist the operator, such as a forward collision warning system, an automatic emergency braking system, a lane departure warning system, and other features described below. The operator assist system 260 thus partially or fully controls operation of the vehicle 105 and/or provides warnings to the operator that help the operator to avoid accidents.

In various embodiments, the vehicle 105 also includes the vehicle data system 111. The vehicle data system 111 receives and tracks positioning data, such as global positioning system (GPS) data, to provide navigation assistance to help an operator navigate when the operator controls the vehicle 105 using the operator control system 240. The vehicle data system 111 also provides navigational data to the operator assist system 260 to allow the operator assist system 260 to control the vehicle 105. The vehicle data system 111 is operable to receive and store map data and to track positions of the vehicle 105 relative to the map data using GPS or other positioning information. In addition, the vehicle data system 111 may log the positioning information about trips that are being taken and have been taken. Also, as previously described with reference to FIG. 1, the vehicle data system 111 captures the vehicle driving data 101 that may be correlated with the portable driving data 102 to eventually generate the pattern data 170.

In various embodiments, the vehicle data system 111 may collect data from many inputs in generating the vehicle driving data 101. For example, the vehicle data system 111 monitor inputs from the operator control system 240 to monitor an operator's engagement with the pedals and the steering wheel. The vehicle data system 111 may receive inputs from the operator assist system 260 that are used to provide warnings and to partially or fully control operation of the vehicle. The vehicle 105 also may include additional sensors 290 from which the vehicle data system 111 collects data. As described further below, inputs from the operator control system 240, the operator assist system 260, and the additional sensors 290 may provide data about speed, braking, steering, distance to other vehicles, operator actions, and many other types of information that are collected in the vehicle driving data 101 by the vehicle data system 111. It will be appreciated that the vehicle data system 111, the operator control system 240, the operator assist system 260, and the sensors 290 may interoperate, for example, to enable the operator assist system 260 to receive and use data from the operator control system 240 and the sensors 290.

It will be appreciated that, to ensure that the vehicle driving data 101 is attributed to the correct operator, it may be appropriate to identify who is the operator of the vehicle 105. To this end, in various embodiments the vehicle 105 also includes an operator identification system 270 in communication with the vehicle data system 111 to identify the operator.

Figure 3:
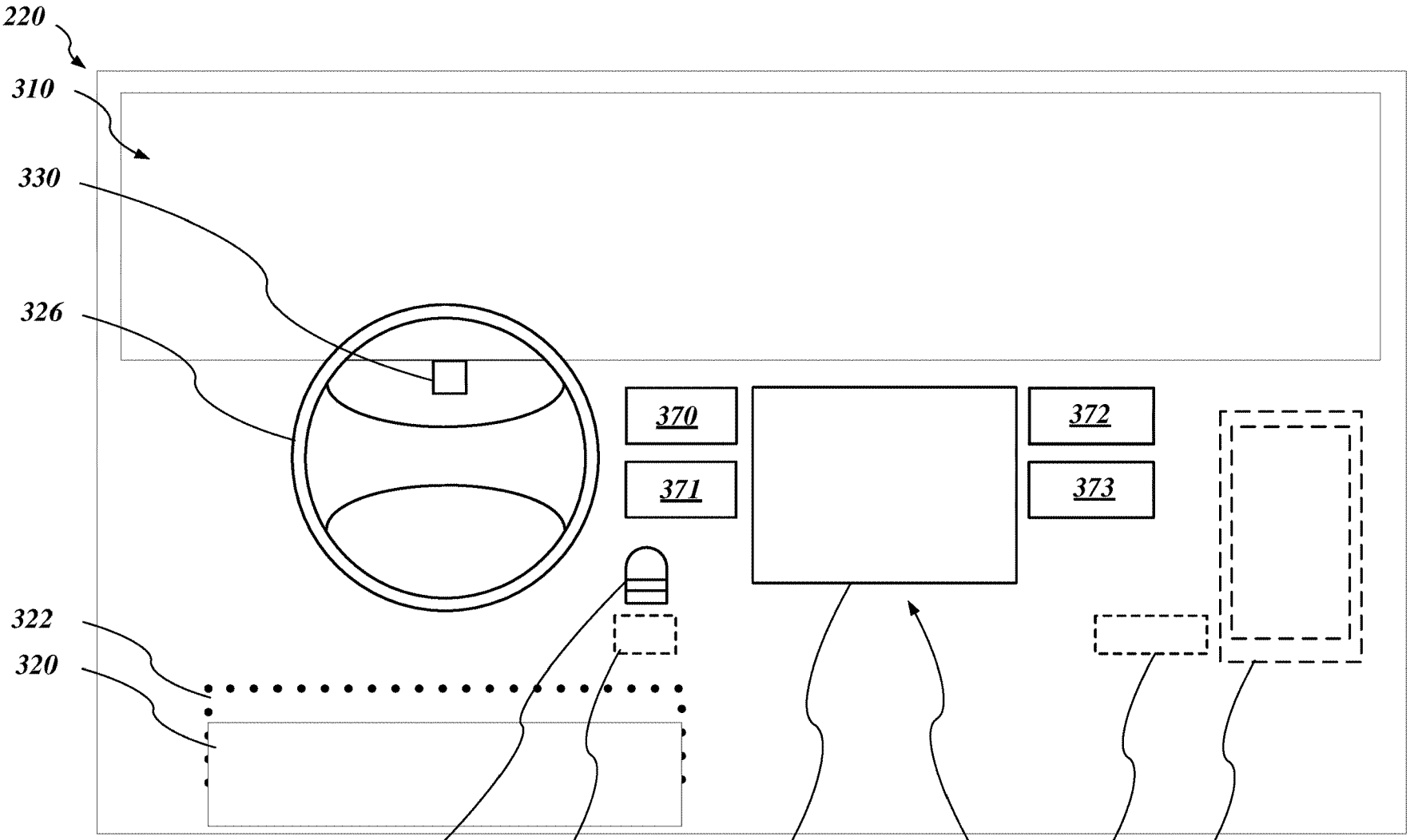
FIG. 3 is a perspective view of a cabin of a vehicle supporting the system of FIG. 1.

Referring to FIG. 3, in various embodiments, a cabin 220 of the vehicle 105 (FIGS. 1 and 2) includes an operator display and input system 250 (FIG. 2), which may include a display 365 and a number of controls 370-373. It will be appreciated that the display 365 may include a touchscreen or receive voice commands to enable operator or passenger interaction with the operator display and input system 250. The cabin 220 also may include a number of devices for identifying the operator. The cabin 220 familiarly includes a windshield 310 and an operator's seat 320, as well as a steering wheel 326 and other controls, such as the accelerator, brake pedal, and switches to operate the headlights, wipers, etc. (not shown).

To identify the operator, the cabin 220 may include an operator identification system 270 (FIG. 2) that includes some or all of a number of identification devices. A camera or other imaging device 330 is positioned to image the operator who may be identified by using image recognition. The operator also may be identified by the operator's seat 320 being moved to an adjusted position 322 that is favored by a particular operator. The position may be settable by selecting one of a number of memory buttons (not shown) assignable to each of a number of operators. Also, the cabin 220 may include a key fob identifier 342 that not only recognizes that a key fob 344 is authorized to operate the vehicle, but to recognize when the key fob 344 is that assigned to a particular operator. The key fob 344 may, for example, include an individualized radio frequency identification (RFID) tag and the key fob identifier 342 may include an RFID reader. Also, the cabin 220 may include a phone connection system 352 that, in addition to enabling a smartphone 354 to interact with the vehicle's entertainment system or other systems, identifies whether the smartphone 354 is associated with a particular operator of the vehicle.

In addition to the onboard systems, various embodiments may communicate with remote computing systems. For example, it may be desirable to communicate the vehicle driving data 101 or the portable driving data 102 (FIG. 1) to a remote computing system that supports the analysis system 100 or the evaluation system 175.

Figure 4:
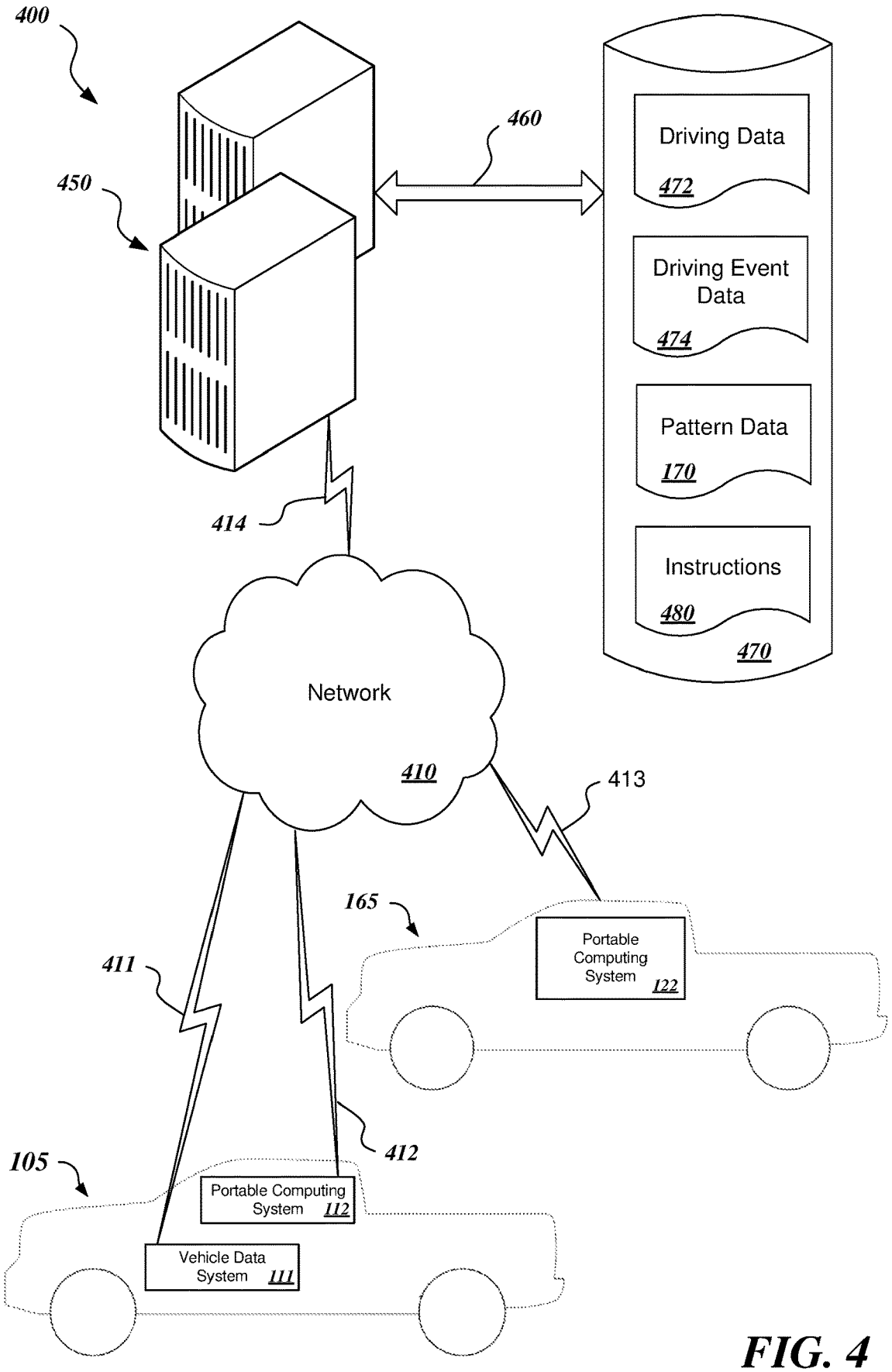
FIG. 4 is a block diagram of illustrative computing systems exchanging driving data with one or more remote systems.

Referring to FIG. 4, an operating environment 400 of the vehicles 105 and 165 may include a remote computing system 450. In various embodiments, the remote computing system 450 may be configured to communicate with the vehicle data system 111 of the vehicle 105 and the portable computing systems 112 and 122 of the vehicles 105 and 165, respectively. The vehicle data system 111 and the portable computing systems 112 and 122 may communicate with the remote computing system 450 over a network 410 via communications links 411, 412, and 413, respectively. Because the vehicles 105 and 165 are movable devices, the communications links 411, 412, and 413 generally may be wireless communications links, such as cellular, satellite, or Wi-Fi communications links. However, when one of the vehicles 105 and 165 is stationary, a wired communication link, such as an Ethernet connection, also may be used. The remote computing system 450 communicates with the network 410 with a wired or wireless communications link 414. In various embodiments, the vehicle data system 111 of the vehicle 105 sends the vehicle driving data 101 (FIG. 1) via the network 410 to the remote computing system 450. Similarly, the portable computing systems 112 and 122 of the vehicles 105 and 165 send the portable driving data 102 and 132, respectively, via the network 410 to the remote computing system 450.

The remote computing system 450 may include a server or server farm. The remote computing system 450 may access programming and data used to perform its functions over a high-speed bus 460 with data storage 470. Information maintained in the data storage 470 may include driving data 472 that includes the vehicle driving data 101 and the portable driving data 102 and 132. The vehicle driving event data 151 and the portable driving event data 152 and 182 may be stored in the data storage as driving event data 474. The pattern data 170 generated from the vehicle driving event data 151 and the portable driving event data 152 also may be maintained in the data storage 470. In addition, computer executable instructions 480, include operating system code, database management code, communications management code, and other instructions may be stored in the data storage 470. Included in the instructions 480 are computer-executable instructions to receive the driving data 101, 102, and 132, and identify the driving event data 151, 152, and 182, assign risk levels 155 and 185 to the driving event data 151, 152, and 182. In addition, instructions to support the correlator 160, generate the pattern data 170, and support the evaluator 180 also may be maintained as instructions 480 in the data storage 470.

Figure 5:
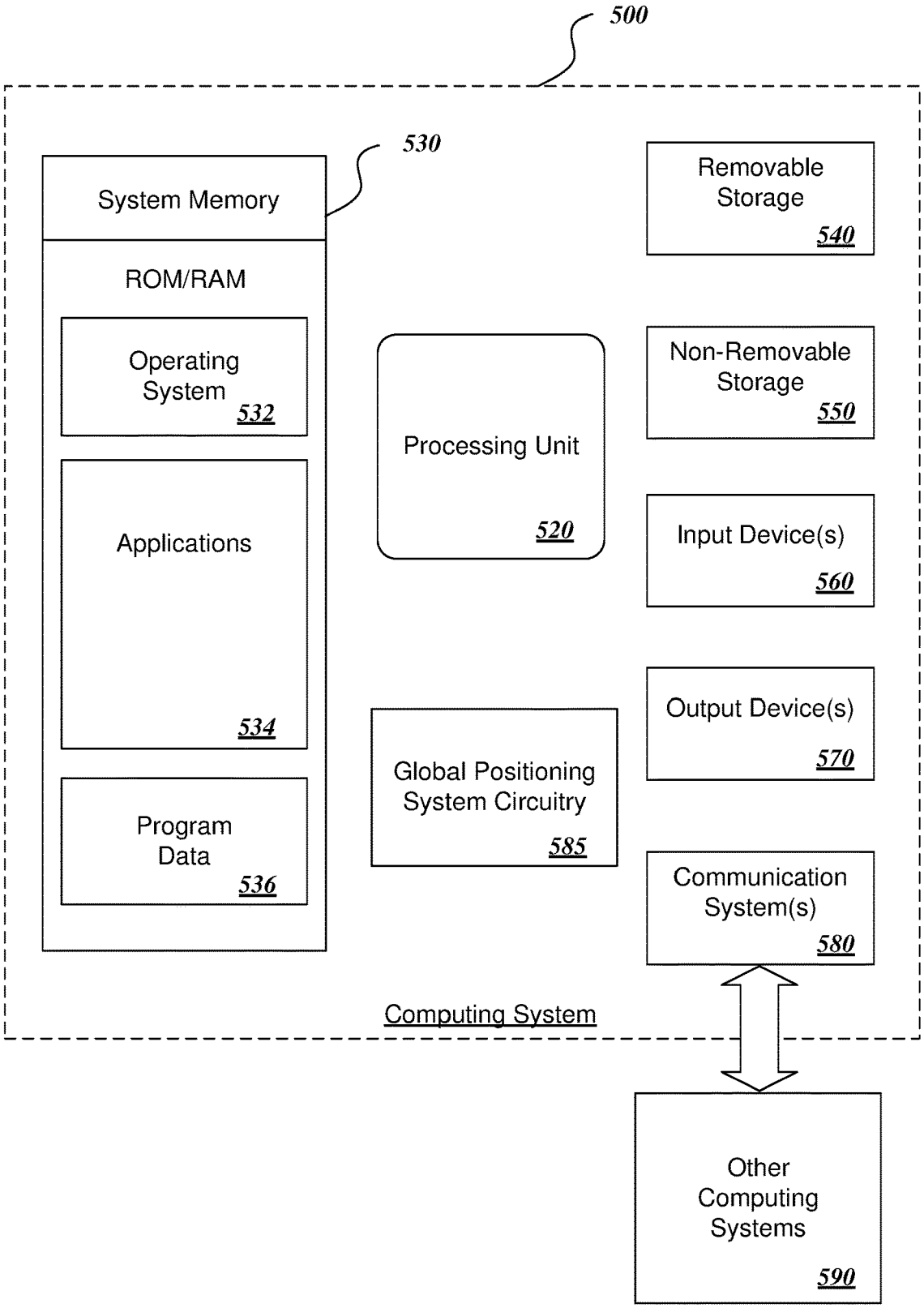
FIG. 5 is a block diagram of an illustrative computing system for performing functions of the systems of FIG. 1.

Referring to FIG. 5, and given by way of example only and not of limitation, some form of a generalized computing system 500 may be used for the vehicle data system 111 of the vehicle 105, the portable computing systems 112 and 122 of the vehicles 105 and 165 (FIGS. 1 and 4), respectively, and the remote computing system 450 (FIG. 4). In various embodiments, the computing system 500 typically includes at least one processing unit 520 and a system memory 530. Depending on the exact configuration and type of computing system, the system memory 530 may be volatile memory, such as random-access memory ("RAM"), non-volatile memory, such as read-only memory ("ROM"), flash memory, and the like, or some combination of volatile memory and non-volatile memory. The system memory 530 typically maintains an operating system 532, one or more applications 534, and program data 536. For example, the analysis system 100 and evaluation system 175, including the correlator 160 and the evaluator 180 (FIG. 1), may include applications that utilize artificial intelligence, neural networks, and deep learning systems that are adapted to analyze the vehicle driving data 101 and portable driving data 102 and 132 as described herein. The operating system 532 may include any number of operating systems executable on desktop or portable devices including, but not limited to, Linux, Microsoft Windows®, Apple OS®, or Android®, or a proprietary operating system.

The computing system 500 may also have additional features or functionality. For example, the computing system 500 may also include additional data storage devices (removable and/or non-removable) such as, for example, magnetic disks, optical disks, tape, or flash memory. Such additional storage is illustrated in FIG. 5 by removable storage 540 and non-removable storage 550. Computer storage media may include volatile and non-volatile, removable and non-removable media implemented in any method or technology for storage of information, such as computer-readable instructions, data structures, program modules or other data. The system memory 530, the removable storage 540, and the non-removable storage 550 are all examples of computer storage media. Available types of computer storage media include, but are not limited to, RAM, ROM, EEPROM, flash memory (in both removable and non-removable forms) or other memory technology, CD-ROM, digital versatile disks (DVD) or other optical storage, magnetic cassettes, magnetic disk storage or other magnetic storage devices, or any other medium which can be used to store the desired information and which can be accessed by the computing system 500. Any such computer storage media may be part of the computing system 500.

The computing system 500 may also have input device(s) 560 such as a keyboard, mouse, stylus, voice input device, touchscreen input device, etc. Output device(s) 570 such as a display, speakers, printer, short-range transceivers such as a Bluetooth transceiver, etc., may also be included. The computing system 500 also may include one or more communication systems 580 that allow the computing system 500 to communicate with other computing systems 590, for example, as the vehicle data system 111 and portable computing system 112 aboard the vehicle 105 and the portable computing system 122 (FIG. 1) communicates with the remote computing system 450 (FIG. 4) and vice versa. As previously mentioned, the communication system 580 may include systems for wired or wireless communications. Available forms of communication media typically carry computer-readable instructions, data structures, program modules or other data in a modulated data signal such as a carrier wave or other transport mechanism and includes any information delivery media. The term "modulated data signal" may include a signal that has one or more of its characteristics set or changed in such a manner as to encode information in the signal. By way of illustrative example only and not of limitation, communication media may include wired media such as a wired network or direct-wired connection, and wireless media such as acoustic, radio frequency (RF), infrared and other wireless media. The term computer-readable media as used herein includes both storage media and communication media.

In further reference to FIG. 5, the computing system 500 may include global positioning system ("GPS") circuitry 585 that can automatically discern its location based on relative positions to multiple GPS satellites. As described further below, GPS circuitry 585 may be used to determine a location and generate data about acceleration, speed, braking, turning, and other movement of the vehicles 105 and 165.

As previously described, the vehicle data system 111 of the vehicle 105 gathers data from a number of inputs. The inputs may come from the operator control system 240, the operator assist system 260, and the additional sensors 290. The data provided by these devices may provide data about speed, braking, steering, distance to other vehicles, operator actions, and many other types of information that are collected in the vehicle driving data 101 by the vehicle data system 111. Although various subsystems or devices described below may be separately attributed to being included in the operator control system 240, the operator assist system 260, or otherwise, it will be appreciated that disclosed embodiments are not limited to any particular grouping of these devices into or with other devices.

Figure 6:
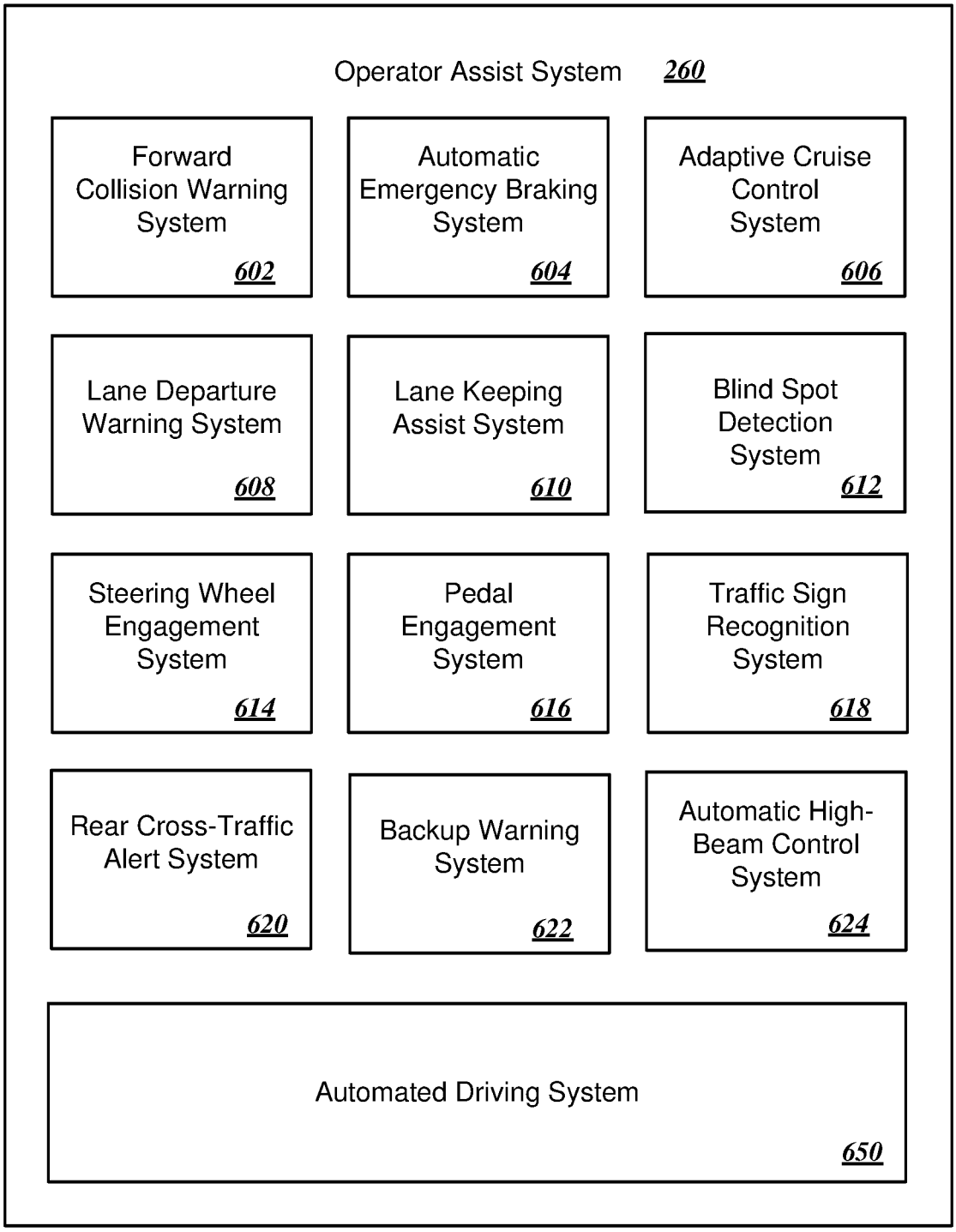
FIG. 6 is a block diagram of an operator assist system sensor of FIG. 1.

Referring to FIG. 6, the operator assist system 260 includes a number of subsystems that may provide data received by the vehicle data system 111 and included in the vehicle driving data 101. In various embodiments, the operator assist system 260 may include a forward collision warning system 602 to alert an operator, proceeding at a normal travel speed, of a stopped vehicle or other object in the road. The engagement of the forward collision warning system 602, or repeated use of the engagement of the forward collision warning system 602, may be indicative of operator inattention. Similarly, the operator assist system 260 may include an automatic emergency braking system 604. While the forward collision warning system 602 alerts the operator to apply the brakes to avoid a stoppage or other object in the road, the automatic emergency braking system 604 actually automatically engages the brakes to stop the vehicle 105 (FIG. 1) of its own accord when a stoppage or other object is detected in the road. The engagement of the emergency braking system 604 also may be indicative of operator inattention.

The operator assist system 260 also may include an adaptive cruise control system 606. The adaptive cruise control system 606 automatically adjusts a cruising speed, set by the operator or the cruise control system, to reflect the speed of traffic ahead. For example, if an operator sets the adaptive cruise control system 606 to a posted highway speed of 65 miles per hour but, because of traffic, the speed of vehicles in the road ahead travel varies between 55 and 65 miles per hour, the adaptive cruise control system 606 will repeatedly adjust the cruising speed to maintain a desired distance between the vehicle and other vehicles in the road ahead.

The operator assist system 260 may include a lane departure warning system 608 that alerts an operator when the vehicle veers close to or across a lane marker and thereby presents an obvious hazard. The operator assist system 260 may include a lane keeping assist system 610 that steers the vehicle to prevent the vehicle from veering close to or across a lane marker.

The operator assist system 260 may include a blind spot detection system 612 that alerts an operator of vehicles traveling in blind spots off the rear quarters of the vehicle to warn the operator not to change lanes in such cases. The operator assist system 260 may include a steering wheel engagement system 614 that detects when the operator has released the wheel. Release of the wheel may be logged as an indication of operator inattention. The operator assist system 260 may include a pedal engagement system 616 that detects when the operator's foot is in contact with the accelerator pedal or the brake pedal. The timing of the operator in engaging one of the pedals also may be logged as an indication of operator inattention. The operator assist system 260 also may include a traffic sign recognition system 618 that, for example, recognizes stop signs or speed limit signs.

The operator assist system 260 also may include a rear cross-traffic alert system 620 to apprise an operator of the approach of other vehicles when the vehicle is moving out of a space. Similarly, the operator assist system 260 may include a backup warning system 622 that warns the operator when the vehicle is approaching an object behind the vehicle. The operator assist system 260 may include an automatic high-beam control system 624 to de-activate and re-activate high beams as other cars approach and then pass by. Availability of such a system may reduce the likelihood of incidents during travel on highways or surface streets with insufficient or no lighting. The operator assist system 260 also may include an automated driving system 650 that provides for full, autonomous control of the vehicle.

Figure 7:
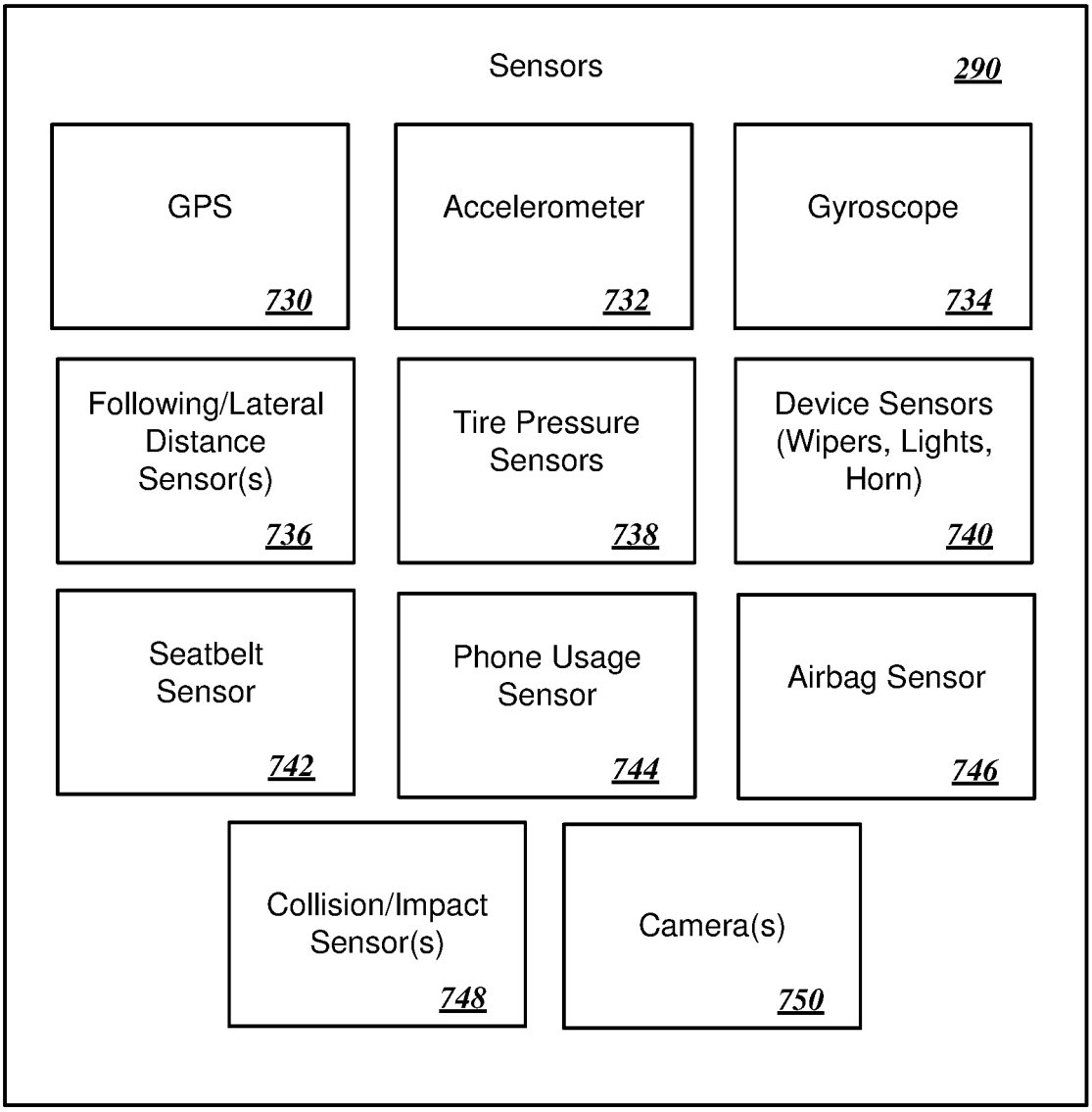
FIG. 7 is a block diagram of sensor systems useable by the system of FIG. 1.

Referring to FIG. 7, in addition to the devices included in the operator assist system 260, the vehicle data system 111 may receive inputs from a number of other sensors 290 whose information is logged in the vehicle driving data 101 (FIG. 1). The sensors 290 may include a GPS device 730 to monitor position and movement of the vehicle 105 (FIG. 1). The sensors 290 also may include an accelerometer 732 to detect rapid accelerator or deceleration that potentially may indicate overly-aggressive driving or hard braking as a result of operator inattention or dangerous traffic patterns. The sensors 290 may include a gyroscope 734 to detect abrupt changes of direction indicative of a treacherous road, sharp lane changes, or abrupt turns. The sensors 290 may include at least one following distance/lateral distance sensor 736 to determine how closely the vehicle 105 follows other vehicles or how closely the vehicle 105 passes next to other vehicles. The following distance/lateral distance sensor 736 may use any technology that can determine following distance from another vehicle, such as radar, LIDAR, optical measurement made using cameras or other optical sensors, ultrasonic measurement, laser measurement, or any other technology that can be used to determine following distance from another vehicle.

The sensors 290 may also include device sensors, such as tire pressure sensors 738 to monitor whether the tires are inflated to a recommended level. The sensors 290 also may include miscellaneous device sensors 740 to determine whether other systems, such as the lights, horn, and wipers have been used on particular routes. The sensors 290 may also include a seatbelt sensor 742 to indicate whether the occupants wore seatbelts on particular routes. The sensors 290 may also include a phone usage sensor 744 (which may take the form of an app executing on the phone) to report whether the operator was handling or operating the operator's phone on particular routes. The sensors 290 may include an airbag deployment sensor 746 or a collision sensor 748 to report a catastrophic event that resulted in a collision and/or a serious collision that warranted deployment of the airbag. Finally, the sensors 290 may include one or more cameras 750 to detect and evaluate conditions in and around the vehicle 105. The cameras 750 outside of the vehicle may be able to monitor position of the vehicle relative to other vehicles and position of the vehicle on the road, to monitor travel conditions such as traffic, weather, and roadway conditions, and to collect other data. The cameras 750 inside of the vehicle may be used to identify the operator, determine whether occupants are wearing seatbelts, whether an operator is distracted, and gather other information.

The data collected from these devices may be received by the vehicle data system 111 and included in the vehicle driving data 101. Table 1 presents a list of data that may be included in the vehicle driving data 101. Table 1 includes a data field that may be logged and, for example, a frequency with which the data is sampled and/or stored.

TABLE 1

| Field | Description | Minimum Reporting Frequency |
|---|---|---|
| Driver ID | Unique identifier for each driver when available | NA |
| Trip ID | Unique identifier for a specific trip | NA |
| Trip Start | Start date and time of trip | NA |
| Trip End | End date and time of trip | NA |
| Road Speed | 1 Hz using multiple sensors | 1 Hz |
| GPS Accuracy | | 1 Hz |
| GPS Speed | | 1 Hz |
| GPS Altitude | | 1 Hz |
| GPS Heading | | 1 Hz |
| GPS Latitude | | 1 Hz |
| GPS Longitude | | 1 Hz |
| Accelerometer | | 10 Hz |
| Bluetooth | | 1 Hz |
| Gyroscope | | 10 Hz |
| Collision/Impact Sensors | Calculate in real-time based on available sensor and contextual data | |
| Rear-ended | Calculate in real-time based on available sensor and contextual data | |
| Side impact | Calculate in real-time based on available sensor and contextual data | |
| Airbag Sensors | | 10 Hz |
| Vehicle Roll-over | Calculate in real-time based on available sensor and contextual data | |
| Vehicle Spin-out | Calculate in real-time based on available sensor and contextual data | |
| Vehicle Security Breach | Upon alarm triggering | 1 Hz |
| Odometer | Trip start/end | NA |
| Impact Sensor Event | As it happens | 10 Hz |
| Driver Seatbelt | On on/off | 1 Hz |

TABLE 1-continued

| Field | Description | Minimum Reporting Frequency |
|---|---|---|
| Event | | |
| Passenger Seatbelt Event | On on/off | 1 Hz |
| Following Distance | Identify driving behavior to segment risk factor based on following distance, relative to speed | 10 Hz |
| Hard Braking | Calculate hard brake events | 10 Hz |
| Rapid Acceleration | Calculate rapid acceleration events | 10 Hz |
| Aggressive Cornering | Calculate aggressive cornering | 10 Hz |
| Speed above PSL | Identify time above Posted Speed Limit | Post processing |
| Excessive Speed | Identify time above a fixed speed limit | 1 Hz |
| Distraction, inattention or impairment | Camera, smartphone, or wearable that identifies distraction, inattention or an impairment that reduces the driver's ability to safely control the vehicle | 1 Hz |
| Steering Wheel Engagement System | | 1 Hz |
| Forward Collision Warning | | 10 Hz |
| Lane Departure Warning | | 10 Hz |
| Rear Cross Traffic on/Off | | 10 Hz |
| Rear Cross Traffic Warning | Identify when rear cross traffic event occurs | 10 Hz |
| Traffic Sign Recognition System | | 1 Hz |
| Manual Park Assist On/Off | | 10 Hz |
| Manual Park Assist Warning | Identify when manual park warning event occurs | 10 Hz |
| Navigation in-use | | 1 Hz |
| Auto Emergency Braking Engaged | | 10 Hz |
| Low Tire Air Pressure | Tire pressure below certain threshold (Front right, Front left, Rear right, Rear left) | 1 Hz |
| Autonomous Driving Mode On/Off | On on/off | 10 Hz |
| Adaptive Cruise Control | On on/off | 10 Hz |
| Blindspot Monitoring On/Off | On on/off | 10 Hz |
| Blindspot Warning | Identify when blindspot event occurs | 10 Hz |
| Backup Warning System | | 1 Hz |
| Headlights On/Off | On on/off | 10 Hz |
| Fog Lights On/Off | On on/off | 10 Hz |
| Automatic High Beam Control System | | 1 Hz |
| Rain Sensor | | 10 Hz |
| Windshield Wipers On/Off | On on/off | 10 Hz |

The data of Table 1, which may include some or all of the vehicle driving data 101, is used by the analysis system 100 in the generation of the pattern data 170 (FIG. 1), as further described below.

Figure 8:
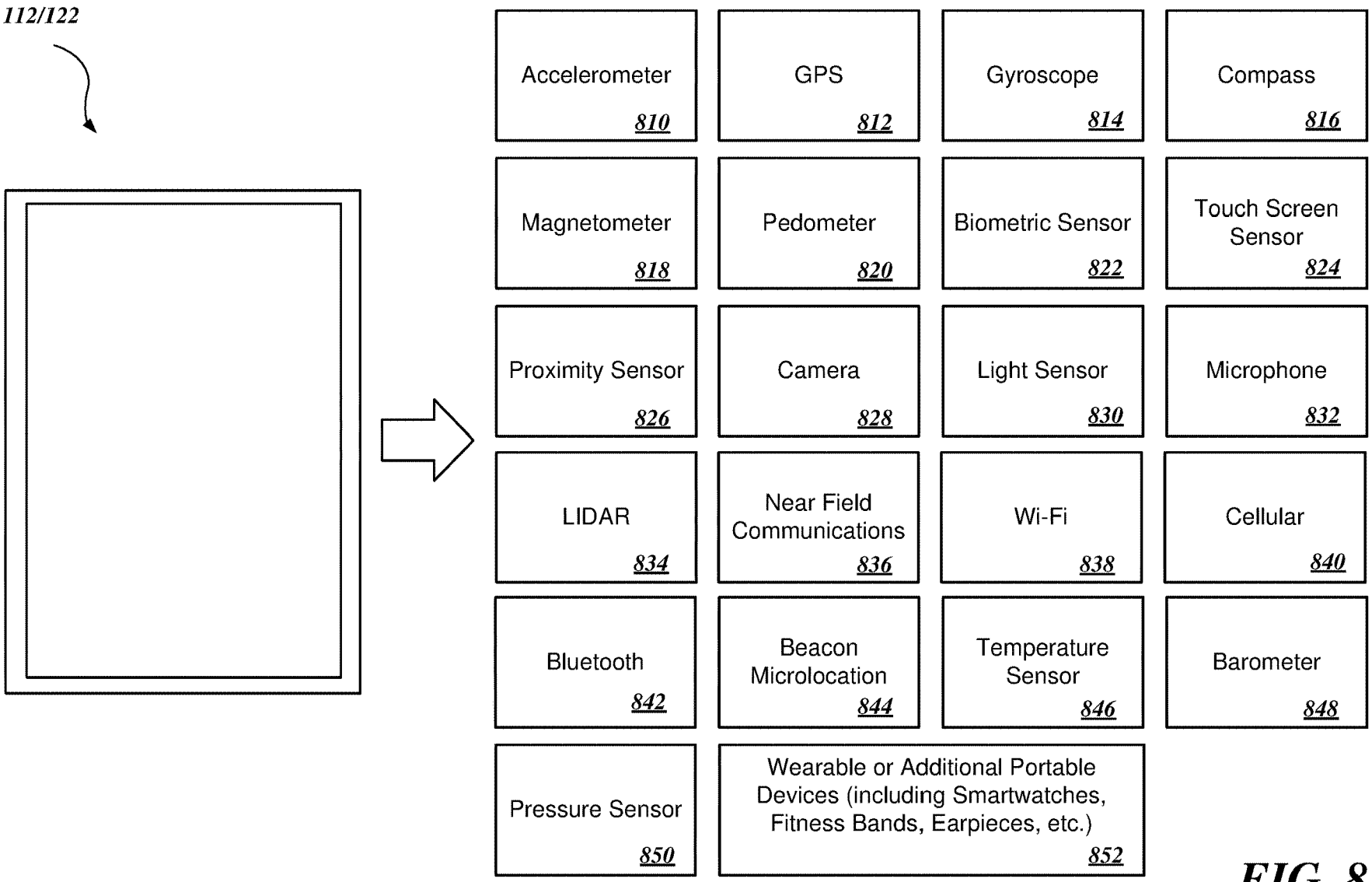
FIG. 8 is a block diagram of a portable computing system and included sensor systems useable by the system of FIG. 1.

Referring to FIG. 8, the portable computing systems 112 and 122 may include portable sensors that generate data that may be included in the portable driving data 102 and 132, respectively (FIG. 1). The portable computing systems 112 and 122 may include smartphones, portable computers, tablet computers, smartwatches, or other types of portable computing systems that may be carried aboard the vehicle 105 or the vehicle 165.

In various embodiments, the portable computing systems 112 and 122 may include a wide array of sensors to collect the portable driving data 102 and 132 for the vehicles 105 and 165, respectively. Examples of some of the sensors that may be used are shown in FIG. 8. It will be appreciated that the portable computing systems 112 and 122 may not include all of the sensors listed or may include additional sensors that are not shown in FIG. 8.

The sensors may include one or more accelerometers 810 that may be used to sense acceleration of the portable computing systems 112 and 122 in one or more directions. In various embodiments, the accelerometers 810 can detect stops and starts as well as side-to-side movement of the portable computing systems 112 and 122 that may reflect corresponding movements of the vehicle 105 or the vehicle 165, respectively. A GPS device 812 also may be used to monitor speed and motion of the portable computing systems 112 and 122 that may reflect corresponding movements of the vehicle 105 or the vehicle 165, respectively. One or more gyroscopes 814 may be used to detect the attitude and orientation of the vehicle in two-dimensional or three-dimensional space. A compass 816 also may be used to determine the orientation of the vehicle. One or more magnetometers 818 may be used to detect the presence of other vehicles or to perform other functions.

The portable computing systems 112 and 122 also may include a pedometer 820 that, in having circuitry capable of detecting a number of steps taken by a user, can be used to detect other movement of the portable computing systems 112 and 122 which may include, for example, when an operator is using the portable computing systems 112 and 122 within the vehicle. One or more biometric sensors 822 may be used to identify or detect a particular user by fingerprint identification, facial recognition, or other techniques. A touch screen sensor 824 may be used to determine when an operator is using the portable computing systems 112 and 122 which, potentially, may indicate distracted driving. A proximity sensor 826 also may be used to detect engagement with the portable computing systems 112 and 122. One or more cameras 828, light sensors 830, microphones 832, and/or light detection and ranging or laser imaging, detection, and ranging devices (LIDAR) 834 also may be used to monitor the environment within the vehicle to identify an operator or detect the presence of other persons in the vehicle and to monitor their activities to detect distracted driving and perform other functions.

Communication systems, such as near field communications circuitry 836, Wi-Fi circuitry 838, cellular communications circuitry 840, Bluetooth circuitry 842, and/or beacon microlocation circuitry 844 may be used to determine the location of the vehicle relative to global coordinates or relative to other known signal sources. Weather conditions may be monitored using a temperature sensor 846, a barometer 848, and other pressure sensors 850. In addition, the portable computing systems 112 and 122 may communicate with other wearable or additional portable devices 852 to determine condition of an operator or movements that may be indicative of an operator's attentiveness or distractedness. These devices may include smartwatches, fitness bands, earpieces (including headsets, earbuds, and similar audio devices that include voice recognition systems and other processing capabilities), and other devices that may be used to monitor conditions and actions of an operator.

As previously described, comparative analysis of the vehicle driving data 101 and the portable device driving data 102 from the vehicle 105 may be used to identify patterns derivable from the portable driving data 102 so that the portable driving data 132 alone may be used to evaluate driving of the vehicle 165.

Figure 9A:
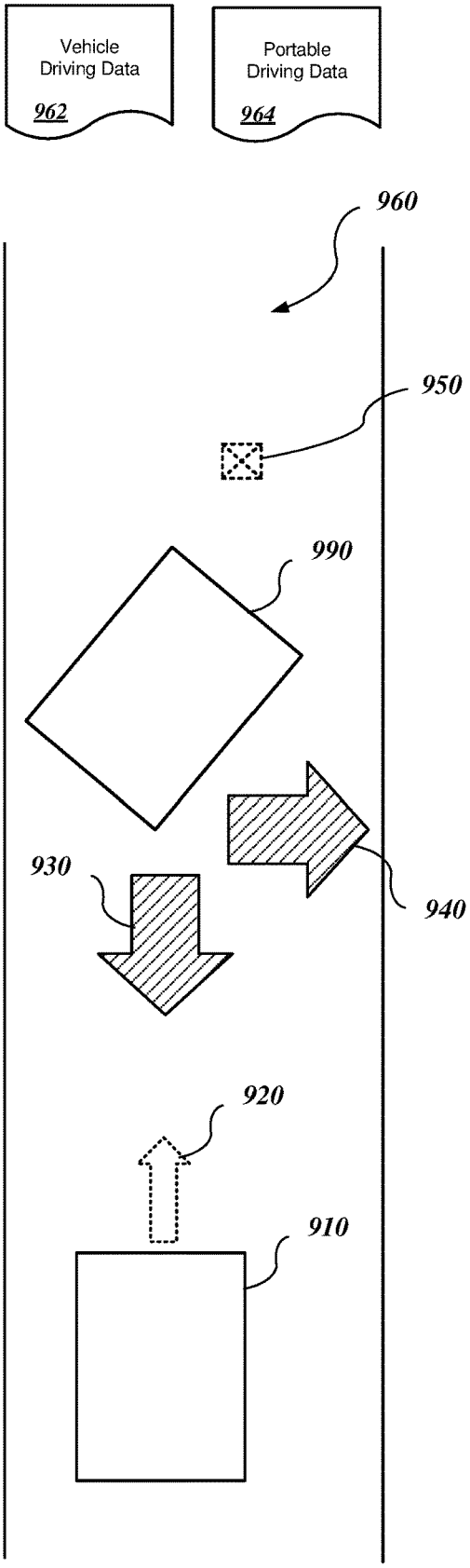
Figure 9B:
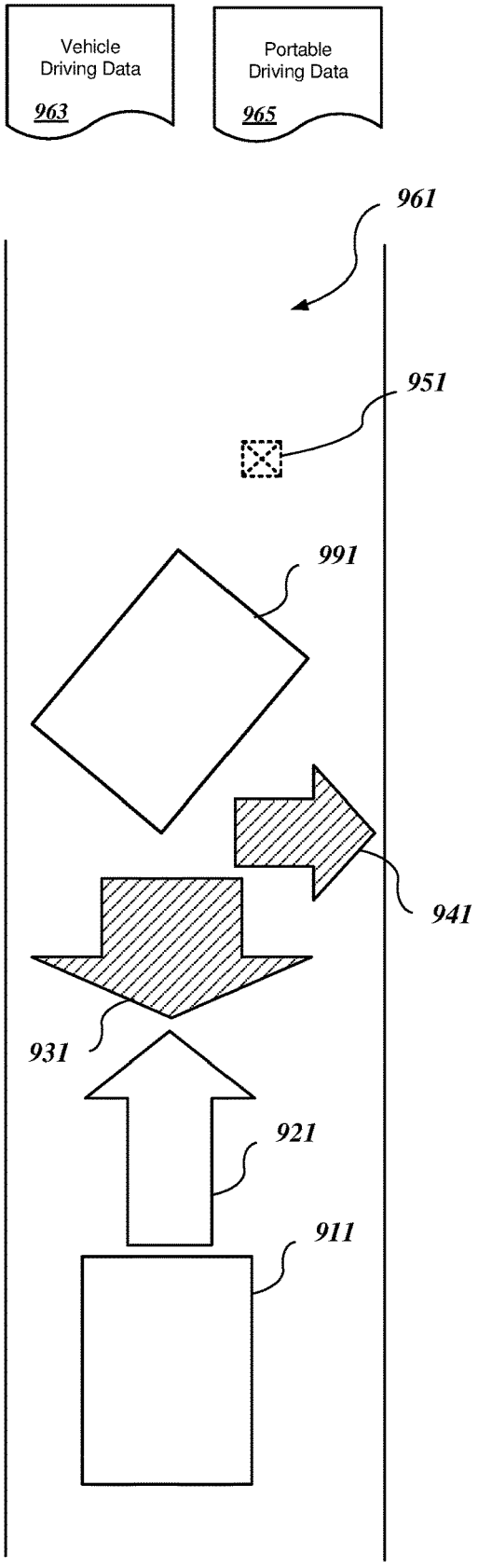

Referring to FIGS. 9A and 9B, a vehicle may narrowly miss a collision, but the driving conduct leading up to the near collision may be measurably different. In the example of FIG. 9A, a vehicle 910 uses moderate acceleration 920 (depicted by a medium-sized, dotted arrow) when moving toward an object 950 in the road 960. The object 950 may include debris lying in the road 960, a person or animal that suddenly moved into the road 960, or any other object. Upon seeing the object 950, the operator of the vehicle 910 performs hard braking 930 and swerving 940 to avoid colliding with the object 950. Both vehicle driving data 962 from a vehicle data system (not shown in FIG. 9A) and portable driving data 964 reflect the acceleration 920, hard braking 930, and swerving 940. In the example of FIG. 9B, a vehicle 911 uses high acceleration 921 (depicted by a large-sized, solid-lined arrow) when moving toward an object 951 in the road 961. Upon seeing the object 951, the operator of the vehicle 910 performs very hard braking 931 (represented by the large arrow) and swerving 941 to avoid colliding with the object 951. Both vehicle driving data 963 from a vehicle data system (not shown in FIG. 9B) and portable driving data 965 reflect the high acceleration 921, very hard braking 931, and swerving 941.

In both cases, the vehicle driving data 962 and 963 may potentially be assigned a high-risk level (as shown in FIG. 1) because of the hard braking and swerving involved in each case. In the instance represented by FIG. 9A, the vehicle driving data 962 may include, for example, data captured from a camera 750 (FIG. 7) that shows that the object 950 appeared suddenly in the road 960 and, thus, indicate safe and attentive operation of the vehicle 910. However, there may not be any identifiable pattern in the portable driving data 964 that may differentiate the operating behavior as being safe or not. The sudden hard braking 930 and the swerving 940 after moderate acceleration 920 evident in the portable driving data 964 may not, in subsequent instances, help to indicate the risk manifest in the operating behavior.

By contrast, in the instance represented by FIG. 9B, in comparing the vehicle driving data 963 with the portable driving data 965, the use of high acceleration 921 may correspond with an input from the pedal engagement system 616 (FIG. 6) included in the vehicle driving data 963 showing that the operator of a vehicle 911 was late to engage the brake pedal in initiating the very hard braking 931. The evaluator 100 (FIG. 1) thus may find that patterns of high acceleration 921 and very hard braking 931 in the portable driving data 965 may consistently correspond with instances where the vehicle driving data 963 shows late engagement of the brake pedal. Thus, in other situations where a vehicle does not have a vehicle data system 111 (FIG. 1) to generate vehicle driving data 962 or 963, the portable driving data 964 or 965 alone may indicate high risk operating behavior when a pattern of high acceleration 921 and very hard braking 931 is presented in the portable driving data 964 or 965.

Figure 10:
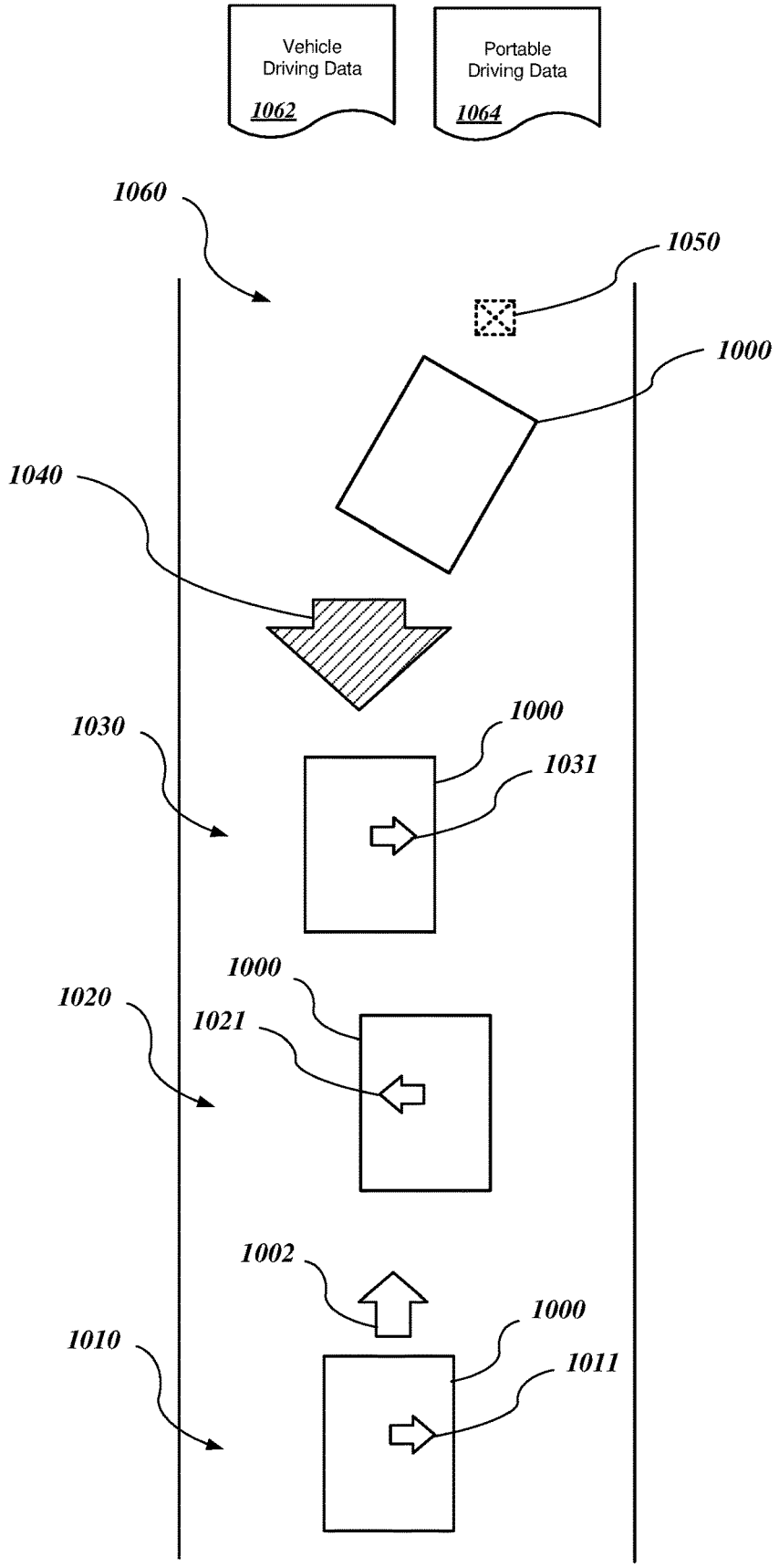

Referring to FIG. 10, another example of operation of a vehicle 1000 represents how pattern data may be derived from vehicle driving data 1062 and portable driving data 1064 to identify patterns in subsequently-captured portable driving data without benefit of vehicle driving data. The vehicle 1000 uses moderate acceleration 1002 (depicted by an arrow) when moving toward an object 1050 in the road 1060. At a position 1010 when the vehicle 1000 begins to accelerate, a steering correction 1011 is made to one side of the road 1060. As the vehicle 1000 advances to a position 1020, another opposite steering correction 1021 is made to the other side of the road 1060. As the vehicle 1000 advances to a position 1030, another steering correction 1031 is made to the opposite side of the road 1060 as the preceding steering correction 1021. Then, as the vehicle approaches the object 1050, hard braking 1040 is used to avoid colliding with the object 1050. The evaluator 100 (FIG. 1) may compare the vehicle driving data 1062 and the portable driving data 1064 to derive a pattern 170 that may be identifiable from subsequently-captured portable driving data alone.

As previously described, operator actions, such as swerving or braking to avoid a collision may reflect appropriate operator conduct. By contrast, correlating the vehicle driving data 1062 and the portable driving data 1064 may be used to identify patterns in the portable driving data 1064 that should be identified as high risk. In the example of FIG. 10, for example, the vehicle driving data 1062 may include input from the steering wheel engagement system 614 (FIG. 6) that shows that the operator sporadically or loosely engaged the steering wheel which may have resulted in the steering corrections 1011, 1021, and 1031. Further, a series of steering corrections 1011, 1021, and 1031, followed by hard braking 1040 may be correlated with the pedal engagement system 616 not having a foot on either pedal. Accordingly, a pattern of steering corrections 1011, 1021, and 1031 followed by hard braking 1040 may be detected by one or more accelerometers 732 (FIG. 7) in the portable computing system and thus be captured in the portable driving data 1064. Thus, when a similar pattern is detected in portable driving data, even without a set of vehicle driving data for comparison, that pattern may be identified as high risk.

Figures 11A, 11B:
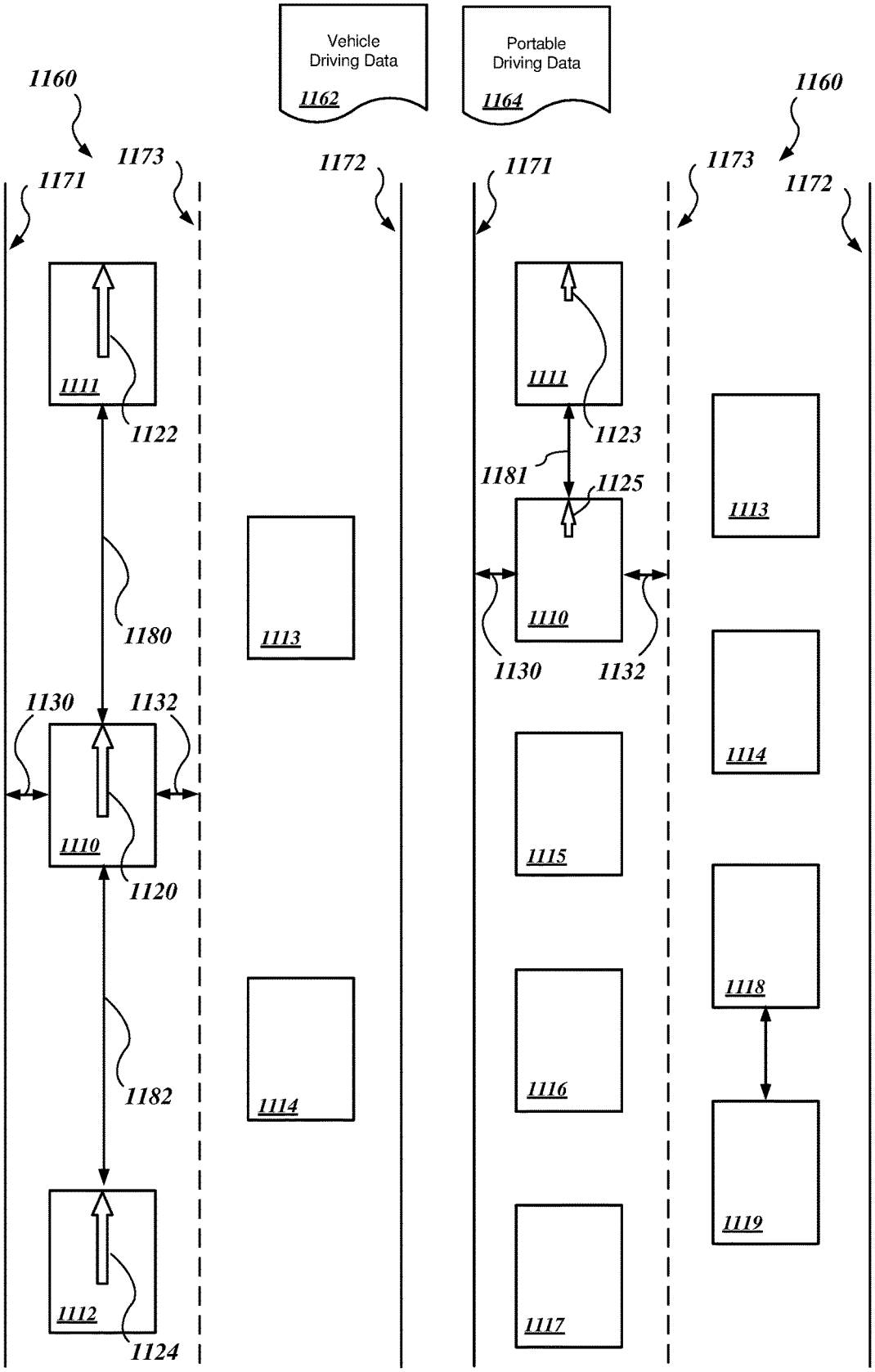

Comparative analysis of the vehicle driving data 101 and the portable device driving data 102 reflecting how a vehicle operates in response to traffic conditions also may be used to identify patterns derivable from the portable driving data 102 so that the portable driving data 132 alone may be used to evaluate driving of the vehicle 165. Referring to FIGS. 11A and 11B, a vehicle 1110 is operated in response to changing traffic conditions on a two-lane road 1160. The road 1160 includes edge lines 1171 and 1172 and a dashed lane dividing line 1173. Referring to FIG. 11A, the vehicle 1110 is assumed to be traveling at a posted speed represented by a vector 1120 when traffic does not impede travel. Traveling at the posted speed represented by a vector 1120, the vehicle 1110 travels at a same speed represented by a vector 1122 as a leading vehicle 1111. By travelling at the same speed as the leading vehicle 1111, the vehicle 1110 maintains a consistent, safe following distance behind the leading vehicle 1111 so that the vehicle 1110 may, for example, be stopped short of a collision if the leading vehicle should suddenly stop. Ideally, a trailing vehicle 1112 also travels at a same speed as represented by a vector 1124 for the same reason—to allow a safe following distance 1182. Also ideally, the vehicle 1110 travels in a center of its lane, at equal distances 1130 and 1132 from an adjacent edge line 1171 and the lane dividing line 1173.

Referring to FIG. 11B, when traffic congestion builds, the leading vehicle 1111 reduces its speed to a lower speed represented by a vector 1123. The vehicle 1110 corresponding reduces its speed to the same lower speed represented by a vector 1125 to leave a safe following distance 1181. (It will be appreciated that the following distance 1181 at the reduced speed may be lower than the following distance 1180 of FIG. 11A because a shorter distance is required to react and/or stop when travelling at a lower speed.) Ideally, the vehicle 1110 continues to travel in a center of its lane, at the equal distances 1130 and 1132 from an adjacent edge line 1171 and the lane dividing line 1173. If the vehicle 1110 is operated attentively to the change in traffic conditions, the speed of the vehicle 1110 is reduced gradually without any swerving within its lane as may attend abrupt braking or stopping. The appropriate response to traffic may be controlled manually by an operator or may be automatically handled by operator assistance and/or automated driving facilities aboard the vehicle 1110.

In this example of the vehicle 1110 appropriately adjusting to changes in traffic, the vehicle driving data 1162 may record the change in speed of the vehicle from the speed represented by the vectors 1120 and 1125 and, using various vehicle sensors, record lack of swerving of the vehicle 1110 and the distances 1180, 1130, and 1132 maintained behind the leading vehicle 1110 and between edges of its lane, respectively. The portable driving data 1164 may not have the capability to discern the distances 1180, 1130, and 1132, but nonetheless may detect a gradual change in speed and a lack of swerving within the lane traveled by the vehicle 1110. Comparison of the portable driving data 1164 with the vehicle driving data 1162 may therefore be able to discern behaviors indicative of appropriate, careful driving based on gradual speed changes whether managed by an operator or by operator assistance and/or automated driving facilities aboard the vehicle 1110.

By contrast, if an operator is not using operator assistance and/or automated driving facilities or is not driving carefully, behaviors may be manifest in the portable driving data 1164 (that is verifiable from the vehicle driving data 1162) that are indicative of operator assistance not being used and/or the operator not driving at a predetermined level of care based on monitoring speed, braking, following distances, and other parameters being monitored. Referring to FIG. 12A, as in the example of FIGS. 11A and 11B, a vehicle 1210 travels at a speed represented by a vector 1220 that is the same as a speed traveled by a leading vehicle 1211 and represented by a vector 1222, leaving a following distance of 1280. At the same time, the vehicle 1210 travels in a middle of its lane 1260, at equal distances 1230 and 1232 from an edge line 1271 and a lane dividing line 1273. As previously described with reference to FIGS. 11A and 11B, the vehicle 1210 maintaining a speed consistent with a leading vehicle 1211 may allow for a consistent, safe following distance between the vehicle 1210 and the leading vehicle 1211.

By contrast, referring to FIG. 12B, if the vehicle 1210 maintains the speed represented by vector 1220 when the leading vehicle 1211 accelerates to a speed represented by vector 1223, an increased following distance 1281 may open between the vehicle 1210 and the leading vehicle 1211. In response, referring to FIG. 12C, an operator (not shown) may accelerate the vehicle 1210 to a greater speed represented by a vector 1225 but, when the leading vehicle decelerates to a speed represented by a vector 1224, a following distance is cut to a distance 1283 and the operator abruptly brakes the vehicle 1210 to impart a high deceleration represented by a vector 1226 to avoid a collision with the leading vehicle 1211. With the high deceleration represented by the vector 1226, the vehicle may swerve to one side as represented by a vector component 1227, thus moving the vehicle 1210 from a center of the lane 1260 at equal distances 1230 and 1232 from an edge line 1271 and a lane dividing line 1273.

Based on the events represented by FIGS. 12A-12C, the vehicle driving data 1262 may capture data including the changing speed of the vehicle represented by the vectors 1220, 1225, and 1226, the changing following distances 1280, 1281, and 1283 between the vehicle 1210 and the leading vehicle 1211, and the swerving of the vehicle 1210 in braking suddenly to avoid a collision. The vehicle driving data 1262, through the use of various sensors, such as cameras and proximity sensors of the vehicle data system 111 (FIG. 1), may also capture data about the varying following distances 1280, 1281, and 1283, the varying distances 1230, 1231, 1232 and 1233 to edges of the lane 1260, the proximity of the vehicle 1210 to the leading vehicle 1211, and the operator's engagement with the steering wheel, accelerator, and brake pedal, and other data. The vehicle driving data 1262 also may include data collected from cameras and other sensors that may indicate whether distracted driving occurred.

The portable driving data 1264, through the use of accelerometers, GPS circuitry, and other sensors in the portable computing device 112 and 122, may also capture data including the changing speed of the vehicle 1210 represented by the vectors 1220, 1225, and 1226, and the swerving of the vehicle 1210 as represented by a vector 1127 in braking suddenly to avoid a collision. The portable driving data 1264 also may use cameras and other sensors to collect indicia of operator phone use or other actions that may have indicated possible distracted driving.

By correlating and evaluating the vehicle driving data 1262 and the portable driving data 1264, indicia and/or patterns present in the portable driving data 1264 may be found to be indicative of quality of the driving behavior. For example, the inconsistent changing speed of the vehicle 1210 represented by the vectors 1220, 1225, and 1226 may be correlated with the vehicle driving data 1262 to show that operator assistance features and/or automated driving facilities were not engaged. The inconsistent changing speed of the vehicle 1210 represented by the vectors 1220, 1225, and 1226 also may show relatively inattentive driving, particularly when culminating in the hard braking represented by the vector 1226. Sensor data captured by the vehicle driving data 1262 and the portable driving data 1264 may both show phone use or other distracted driving behaviors that led to the inconsistent changing speed of the vehicle 1210 represented by the vectors 1220, 1225, and 1226 culminating in the hard braking represented by the vector 1226. As a result of such comparisons, it may be determined that the portable driving data 1264 independently reflects patterns indicative of a high risk level. The ability to compare and analyze the portable driving data 1264 with available vehicle driving data 1262 provides the capacity to better understand the driving information that may be presented in the portable driving data 1264 so that a more accurate assessment of driving behavior and events may be made from the portable driving data 1264 alone when only the portable driving data 1264 is available. Accordingly, when the portable driving data 1264 is collected in a vehicle that is not equipped to collect the vehicle driving data 1262, the portable driving data 1264 alone may be usable to evaluate a risk level associated with the driving behavior.

For another example, abrupt lateral movement and rapid acceleration and deceleration may be analyzed to evaluate driver behavior. Referring to FIG. 13A, a vehicle 1310 may be travelling behind vehicles 1311 and 1312 each travelling at a speed represented by a vector 1322. The operator of the vehicle 1310 may decide to pass one or more of the vehicles 1311 and 1312, accelerating and turning to a speed represented by vector 1325. Referring to FIG. 13B, after passing the vehicle 1311, the operator of the vehicle 1310 may then abruptly pull in behind the vehicle 1312. After accelerating to pass the vehicle 1311, the vehicle 1310 may have to be rapidly decelerated by sudden braking represented by vector 1337 while pulling into the space between vehicles 1311 and 1312.

The vehicle driving data 1362 may capture data including the changing speed of the vehicle represented by the vectors 1325 and 1337 and, following the passing maneuver, the short following distance of the vehicle 1310 behind the vehicle 1312 and the short margin between the vehicle 1310 and the vehicle 1311. As previously described, the vehicle driving data 1362 may include input from cameras or other distance sensors of the vehicle data system 111 (FIG. 1) to capture the details of the maneuver, as well as inputs from the steering wheel, accelerator, and brake pedal to capture operator actions. The portable driving data 1364, through the use of accelerometers, GPS circuitry, and other sensors in the portable computing device 112 and 122 (FIG. 1), may also capture data including the changing speed and swerving of the vehicle 1310 represented by the vectors 1325 and 1337 in passing the vehicle 1311.

As previously described with reference to FIGS. 9A and 9B, sudden braking and turning may be appropriate in some instances, such as to avoid an object in the roadway ahead of a vehicle. However, by correlating and evaluating the vehicle driving data 1362 and the portable driving data 1364, patterns may be found in the portable driving data 1364 that indicate potentially high risk driving behavior rather than attentive, evasive driving. For example, veering in one direction and then in the opposite direction may be warranted to avoid debris or an animal appearing in the road and then return to the vehicle to its course of travel. In the example of FIGS. 13A and 13B, that type of incident may be ruled out by reviewing camera images or other images from the vehicle driving data 1362. In addition, the acceleration and turning of the vehicle 1310 represented by the vector 1325 to pull out to pass the vehicle 1311 is not consistent with a maneuver to avoid an obstacle in the roadway. The acceleration and swerving of the vehicle 1310 represented by the vector 1325 to pull around the vehicle 1311 is detectable by the accelerometers, GPS and other sensors of the portable computing system 112 and 122, as is the rapid deceleration and swerving of the vehicle 1310 in pulling in between the vehicles 1311 and 1312. From comparing and evaluating the vehicle driving data 1362 and the portable driving data 1364, a pattern such as the acceleration of the vehicle 1310 before the swerving and braking may be indicative of high risk driving, while evasive maneuvers not preceded by acceleration may not necessarily indicate risky driving. Again, as a result of such comparisons, it may be determined that the portable driving data 1364 independently reflects patterns indicative of a high risk level which may be collected in portable driving data 1364 event without access to vehicle driving data 1362 provided by a vehicle equipped to provide such data.

Referring to FIG. 14, in various embodiments an illustrative method 1400 of developing a model from parallel sets of driving data to identify the risk level of an event in one of the sets of driving data is provided. The method 1400 starts at a block 1405. At a block 1410, vehicle driving data is received. The vehicle driving data is collected by a vehicle data system operably coupled with at least one sensor aboard a vehicle and configured to collect data representing driving conduct of the operator in operating the vehicle during at least one trip. At a block 1420, portable driving data is received. The portable driving data is collected by a portable data system transportable aboard the vehicle to collect data representing the driving conduct of the operator in operating the vehicle during the at least one trip. At a block 1430, the vehicle driving data and the portable driving data are evaluated. The evaluation includes assigning a risk level to at least one event included in the vehicle driving data based on data provided by the at least one sensor. The evaluation also includes correlating the vehicle driving data with the portable driving data to identify a pattern in the portable driving data that is associable with the risk level. The method 1400 ends at a block 1435.

It will be appreciated that the detailed description set forth above is merely illustrative in nature and variations that do not depart from the gist and/or spirit of the claimed subject matter. Such variations are not to be regarded as a departure from the spirit and scope of the claimed subject matter.

What is claimed is:

1. A system comprising:

a vehicle data system operably coupled with at least one sensor aboard a vehicle and configured to collect vehicle driving data representing driving conduct of the operator in operating the vehicle during at least one trip;

a portable data collection module configured to cause a portable computing system transportable aboard a vehicle to collect portable driving data representing the driving conduct of the operator in operating the vehicle during the at least one trip; and an evaluation system configured to:

receive the portable driving data and the vehicle driving data;

assign a risk level to at least one event included in the vehicle driving data based on data provided by the at least one sensor;

correlate the vehicle driving data with the portable driving data to identify a pattern in the portable driving data that is associable with the at least one event;

assign the risk level to the pattern in the portable driving data;

identify the pattern in subsequently received portable driving data; and assign the risk level to the pattern identified in the subsequently received portable driving data.

2. The system of claim 1, wherein the at least one sensor includes at least one device chosen from a forward collision warning system, an automatic emergency braking system, an adaptive cruise control system, a lane departure warning system, a lane keeping assist system, a blind spot detection system, a steering wheel engagement system, a pedal engagement system, a traffic sign recognition system, a rear cross-traffic alert system, a backup warning system, an automatic high-beam control system; an automated driving system, a global positioning system (GPS) device, an accelerometer, a gyroscope, a following/lateral distance sensor, a tire pressure sensor, a seatbelt usage sensor, a phone usage sensor, an airbag deployment sensor, a collision sensor, a camera, and a device sensor configured to monitor use of a device chosen from at least one of lights, horn, and wipers.

3. The system of claim 1, wherein the vehicle data system includes an operator identifier configured to determine whether the operator was operating the vehicle during the at least one trip.

4. The system of claim 3, wherein the operator identifier includes at least one identifier chosen from a key fob identifier configured to identify the driver based on presence of a key fob associated with the identified driver, a smartphone identifier configured to detect a presence of a smartphone associated with the identified driver onboard the vehicle, a seat position identifier configured to detect a position of a driver's seat previously used by the identified driver, and an imaging system configured to visually recognize the identified driver.

5. The system of claim 1, wherein the portable computing system includes a computing system chosen from a portable computer, a tablet computer, a smartphone, and a smartwatch, and an earpiece.

6. The system of claim 1, wherein the portable data collection module includes an application executable on the portable computing system.

7. The system of claim 5, wherein the portable computing system includes at least one portable sensor chosen from an accelerometer, a GPS device, a gyroscope, a compass, a magnetometer, a biometric sensor, a touch screen sensor, a proximity sensor, a camera, a light sensor, a microphone, a near field communications system, a Wi-Fi communications system, a cellular communications system, a beacon microlocation system, a temperature sensor, a barometer, a pressure sensor, a wearable sensing device, and an additional portable device.

8. A vehicle comprising:

a cabin configured to receive at least one entity chosen from an operator, a passenger, and cargo;

a drive system configured to motivate, accelerate, decelerate, stop, and steer the vehicle;

an operator control system configured to allow the operator to direct operations of the vehicle;

an operator assist system configured to perform at least one function chosen from:

autonomously controlling the vehicle without assistance of the operator; and assisting the operator in controlling the vehicle; and a vehicle data system operably coupled with at least one sensor aboard a vehicle and configured to collect vehicle driving data representing driving conduct of the operator in operating the vehicle during at least one trip and provide the vehicle driving data to an evaluation system, wherein the vehicle driving data is configured to be:

assigned a risk level for at least one event included in the vehicle driving data based on data provided by the at least one sensor; and correlated with portable driving data collected by a portable computing system aboard the vehicle to enable a pattern to be identified in the portable driving data that is associable with the at least one event and the risk level assigned for the at least one event included in the vehicle driving data;

wherein the evaluation system then assigns the risk level to the pattern identified in subsequently received portable driving data.

9. The vehicle of claim 8, wherein the at least one sensor includes at least one device chosen from a forward collision warning system, an automatic emergency braking system, an adaptive cruise control system, a lane departure warning system, a lane keeping assist system, a blind spot detection system, a steering wheel engagement system, a pedal engagement system, a traffic sign recognition system, a rear cross-traffic alert system, a backup warning system, an automatic high-beam control system; an automated driving system, a global positioning system (GPS) device, an accelerometer, a gyroscope, a following/lateral distance sensor, a tire pressure sensor, a seatbelt usage sensor, a phone usage sensor, an airbag deployment sensor, a collision sensor, a camera, and a device sensor configured to monitor use of a device chosen from at least one of lights, horn, and wipers.

10. The vehicle of claim 8, wherein the vehicle data system includes an operator identifier configured to determine whether the operator was operating the vehicle during the at least one trip.

11. The vehicle of claim 10, wherein the operator identifier includes at least one identifier chosen from a key fob identifier configured to identify the driver based on presence of a key fob associated with the identified driver, a smartphone identifier configured to detect a presence of a smartphone associated with the identified driver onboard the vehicle, a seat position identifier configured to detect a position of a driver's seat previously used by the identified driver, and an imaging system configured to visually recognize the identified driver.

12. A computer-implemented method comprising:

receiving vehicle driving data collected by a vehicle data system operably coupled with at least one sensor aboard a vehicle and configured to collect data representing driving conduct of the operator in operating the vehicle during at least one trip;

receiving portable driving data collected by a portable data system transportable aboard the vehicle to collect representing the driving conduct of the operator in operating the vehicle during the at least one trip;

evaluating the vehicle driving data and the portable driving data, including:

assigning a risk level to at least one event included in the vehicle driving data based on data provided by the at least one sensor; and correlating the vehicle driving data with the portable driving data to identify a pattern in the portable driving data that is associable with the at least one event and the risk level assigned to the at least one event included in the vehicle driving data; and then assigning the risk level to the pattern identified in subsequently received portable driving data.

13. The computer-implemented method of claim 12, wherein collecting data representing the driving conduct of the operator in operating the vehicle includes collecting data from at least one device chosen from a forward collision warning system, an automatic emergency braking system, an adaptive cruise control system, a lane departure warning system, a lane keeping assist system, a blind spot detection system, a steering wheel engagement system, a pedal engagement system, a traffic sign recognition system, a rear cross-traffic alert system, a backup warning system, an automatic high-beam control system; an automated driving system, a global positioning system (GPS) device, an accelerometer, a gyroscope, a following/lateral distance sensor, a tire pressure sensor, a seatbelt usage sensor, a phone usage sensor, an airbag deployment sensor, a collision sensor, a camera, and a device sensor configured to monitor use of a device chosen from at least one of lights, horn, and wipers.

14. The computer-implemented method of claim 12, further comprising identifying the operator that was operating the vehicle during the at least one trip.

15. The computer-implemented method of claim 14, wherein identifying the operator includes determining at least one identifier chosen from presence of a key fob associated with the driver aboard the vehicle, presence of a smartphone associated with the driver onboard the vehicle, a position of a driver's seat previously used by the driver, and an image of the driver using an imaging system configured to visually recognize the driver.

16. The computer-implemented method of claim 12, wherein collecting the portable driving data using the portable computing system includes collecting the portable driving data from a computing system chosen from a portable computer, a tablet computer, a smartphone, a smartwatch, and an earpiece.

17. The computer-implemented method of claim 16, further comprising executing an application on the computing system to collect the portable driving data.

18. The computer-implemented method of claim 16, wherein gathering the portable computing data from the portable computing system includes gathering data from a device chosen from at least one portable sensor chosen from an accelerometer, a GPS device, a gyroscope, a compass, a magnetometer, a biometric sensor, a touch screen sensor, a proximity sensor, a camera, a light sensor, a microphone, a near field communications system, a Wi-Fi communications system, a cellular communications system, a beacon microlocation system, a temperature sensor, a barometer, a pressure sensor, a wearable sensing device, and an additional portable device.

* * * * *